US007743584B2

(12) United States Patent
Reichert et al.

(10) Patent No.: US 7,743,584 B2
(45) Date of Patent: Jun. 29, 2010

(54) SPACER ASSEMBLY FOR INSULATING GLAZING UNITS AND METHOD FOR FABRICATING THE SAME

(75) Inventors: Gerhard Reichert, New Philadelphia, OH (US); Michael E. Bricker, Norwich, OH (US)

(73) Assignee: Edgetech I.G., Inc., Cambridge, OH (US)

( * ) Notice: Subject to any disclaimer, the term of this patent is extended or adjusted under 35 U.S.C. 154(b) by 1471 days.

(21) Appl. No.: 10/216,258

(22) Filed: Aug. 8, 2002

(65) Prior Publication Data

US 2003/0074859 A1 Apr. 24, 2003

Related U.S. Application Data

(60) Provisional application No. 60/311,199, filed on Aug. 9, 2001.

(51) Int. Cl.
*E04B 2/40* (2006.01)
*E04B 2/28* (2006.01)

(52) U.S. Cl. ..... 52/745.15; 52/745.16; 52/783.19; 52/783.11; 52/204.595; 428/34

(58) Field of Classification Search ..... 52/786.11, 52/786.13, 793.11, 204.595, 204.597, 172, 52/745.15, 745.16, 717.01, 717.02, 783.19, 52/783.11; 428/34
See application file for complete search history.

(56) References Cited

U.S. PATENT DOCUMENTS 1,777,714 A * 10/1930 Butler et al. ..... 62/529
1,975,895 A * 10/1934 Geyer ..... 52/204.595
2,138,374 A * 11/1938 Edwards ..... 52/204.597
2,294,890 A * 9/1942 Brinker ..... 52/783.11
2,708,774 A * 5/1955 Seelen ..... 428/34
2,850,890 A * 9/1958 Rubenstein ..... 264/228
3,105,274 A * 10/1963 Armstrong ..... 52/204.593
3,256,641 A * 6/1966 Johnson ..... 49/419
3,456,410 A * 7/1969 Johnson et al. ..... 52/309.1
3,555,756 A * 1/1971 Curran et al ..... 52/309.9
3,775,914 A * 12/1973 Patil ..... 52/172

(Continued)

FOREIGN PATENT DOCUMENTS

EP 65510 * 5/1985 ..... 52/786.13

(Continued)

OTHER PUBLICATIONS

Edgetech Advertising—Cushion Edge—earlier than Aug. 9, 2000.

(Continued)

*Primary Examiner*—Phi Dieu Tran A
(74) *Attorney, Agent, or Firm*—Zollinger & Burleson Ltd

(57) ABSTRACT

An insulating glazing unit includes a pair of glazing sheets spaced apart with a spacer assembly. The spacer assembly includes an inner spacer member and an outer spacer member that are fabricated in a linear fashion and then folded into a frame. The outer spacer member may be initially formed in a flat configuration, cut to width, and then wrapped around the inner spacer member to form the spacer assembly. The outer spacer member carries the desiccant of the spacer assembly. The outer spacer member may also be gunned directly to the inner spacer member.

18 Claims, 21 Drawing Sheets

U.S. PATENT DOCUMENTS 3,921,359 A * 11/1975 Brichard et al. ..... 52/786.13
4,006,569 A * 2/1977 Kain ..... 52/204.591
4,109,431 A * 8/1978 Mazzoni et al. ..... 52/172
4,121,394 A * 10/1978 Brooks ..... 52/203
4,193,236 A * 3/1980 Mazzoni et al. ..... 52/172
4,368,226 A * 1/1983 Mucaria ..... 428/34
4,513,546 A * 4/1985 Gow ..... 52/172
4,530,195 A 7/1985 Leopold
4,719,728 A * 1/1988 Eriksson et al. ..... 52/172
4,831,799 A 5/1989 Glover et al.
4,950,344 A 8/1990 Glover et al.
4,994,309 A 2/1991 Reichert et al.
5,007,217 A 4/1991 Glover et al.
5,119,608 A 6/1992 Glover et al.
5,177,916 A 1/1993 Misera et al.
5,209,034 A 5/1993 Box et al.
5,255,481 A 10/1993 Misera et al.
5,290,611 A * 3/1994 Taylor ..... 428/34
5,295,292 A 3/1994 Leopold
5,315,797 A 5/1994 Glover et al.
5,351,451 A * 10/1994 Misera et al. ..... 52/172
5,424,111 A 6/1995 Farbstein
5,436,040 A 7/1995 Lafond
5,441,779 A 8/1995 Lafond
5,443,871 A 8/1995 Lafond
5,447,761 A 9/1995 Lafond
5,485,710 A 1/1996 Lafond
5,491,953 A 2/1996 Lafond
5,494,715 A 2/1996 Glover
5,498,451 A 3/1996 Lafond
5,501,013 A 3/1996 Misera et al.
5,514,432 A * 5/1996 Lisec ..... 428/35.8
5,553,440 A 9/1996 Bulger et al.
5,568,714 A * 10/1996 Peterson ..... 52/786.13
5,601,677 A 2/1997 Leopold
5,616,415 A 4/1997 Lafond
5,644,894 A * 7/1997 Hudson ..... 52/786.13
5,650,029 A 7/1997 Lafond
5,655,282 A * 8/1997 Hodek et al. ..... 29/469.5
5,656,358 A 8/1997 Lafond
5,658,645 A 8/1997 Lafond
5,691,045 A 11/1997 Lafond
5,714,214 A * 2/1998 Larsen ..... 428/34
5,759,665 A 6/1998 Lafond
5,761,946 A * 6/1998 Misera et al. ..... 72/181
5,762,738 A 6/1998 Lafond
5,773,135 A 6/1998 Lafond
5,806,272 A 9/1998 Lafond
5,813,191 A 9/1998 Gallagher
6,035,602 A * 3/2000 Lafond ..... 52/786.13
6,131,364 A * 10/2000 Peterson ..... 52/786.13
6,223,414 B1 * 5/2001 Hodek et al. ..... 29/527.1
6,266,940 B1 7/2001 Reichert
6,339,909 B1 * 1/2002 Brunnhofer et al. ..... 52/786.13
6,528,131 B1 * 3/2003 Lafond ..... 428/34

FOREIGN PATENT DOCUMENTS

EP 430889 * 11/1990 ..... 52/786.13
JP 01203547 A * 8/1989

OTHER PUBLICATIONS

Edgetech Advertising—Super U—earlier than Aug. 9, 2000.

* cited by examiner

SPACER ASSEMBLY FOR INSULATING GLAZING UNITS AND METHOD FOR FABRICATING THE SAME

CROSS REFERENCE TO RELATED APPLICATIONS

This application claims priority from U.S. provisional application Ser. No. 60/311,199 filed Aug. 9, 2001; the disclosures of which are incorporated herein by reference.

BACKGROUND OF THE INVENTION

1. Technical Field

This invention generally relates to spacer assemblies for insulating glazing units and, more particularly, to a spacer assembly having an inner spacer member and an outer spacer member that carries desiccant outside of the inner spacer member. Specifically, the present invention relates to a spacer assembly and a method for fabricating a spacer assembly that uses an inner spacer member that may be formed by existing automated manufacturing equipment in combination with an outer spacer member carrying a desiccant that is wrapped around the outside of the inner spacer member.

2. Background Information

Insulating glazing units are used to reduce heat loss from the interior of a building during cold weather and to retain cooler temperatures inside the building during hot weather. The proper use of insulating glazing units in a building can significantly reduce the cost of heating and cooling the interior of the building.

An insulating glazing unit typically includes at least a pair of outer glazing sheets held together and spaced apart by a spacer assembly. Numerous spacer assembly configurations are known in the art that function to hold the glazing sheets apart from each other while simultaneously forming a hermetically sealed cavity between the glazing sheets and the spacer assembly. Most spacer assemblies include a desiccant to prevent condensation from forming in the sealed cavity.

One known spacer assembly and method for assembling a glazing unit is disclosed in U.S. Pat. No. 4,530,195 that is assigned to Glass Equipment Development, Inc., of Twinsburg, Ohio. The disclosures of this patent are incorporated herein by reference. The spacer assembly disclosed in this patent carries the desiccant inside the metal spacer member. The spacer assembly is formed by cutting frame segments to length and connecting them end-to-end with folding, locking corner keys. As shown in FIGS. 4 and 5 of the patent, a sealant is applied to the three outer sides of the segments by three extrusion nozzles while the segments are linearly aligned. The segments are folded into a polygon and positioned between the glass sheets. The assembly is then passed through a heated roller press to form the insulating glazing unit. This spacer assembly and linear method for fabricating glazing units as well as other similar segmented spacer assemblies that are linearly assembled and then folded have gained success in the art.

Another successful spacer assembly known in the art is sold under the federally registered trademark INTERCEPT® owned by PPG Industries, Inc. of Pittsburgh, Pa. An example of an INTERCEPT® spacer assembly is depicted in FIG. 2 and is indicated by the numeral 8. Spacer assembly 8 includes a metal structural element 10 that has a flat bottom wall 12 and two substantially parallel upwardly extending side walls 14. A stiffening flange or lip 16 may extend from the top of each side wall 14 substantially parallel to the bottom wall 12 and toward one another. A desiccant matrix 18 is disposed inside the metal structural element to adsorb moisture that may enter the cavity 20 of the glazing unit. The outer surface of the metal structural element 10 is coated on three sides with a sealant 22 that bonds the glazing sheets 24 to the spacer assembly 8 and seals cavity 20 from the surrounding atmosphere. U.S. Pat. Nos. 5,177,916, 5,255,481, and 5,351,451 owned by PPG Industries disclose the INTERCEPT® spacer and methods for fabricating the INTERCEPT® spacer. The disclosures of these patents are incorporated herein by reference.

The INTERCEPT® spacer assembly has gained popularity in the marketplace because it can be manufactured with automated manufacturing equipment that produces large quantities of custom-sized spacer assemblies quickly for a low cost. The automated equipment allows the user to create a custom-sized spacer assembly simply by entering the size of the desired glazing unit. The equipment performs the required calculations and controls the machinery to automatically form the required spacer assembly. Companies that use the automated equipment have invested relatively large sums of money (up to $1,000,000) to purchase and set up the automated manufacturing equipment as well as to train employees to use the equipment. Once an automated line is established and the employees trained, the INTERCEPT® spacer is easy and inexpensive to manufacture. The equipment allows that manufacturer to produce up to 2800 frames per work shift. One exemplary method and manufacturing line for automatically manufacturing the INTERCEPT® spacer assembly is disclosed in U.S. Pat. No. 5,295,292 that is assigned to Glass Equipment Development, Inc., of Twinsburg, Ohio. The disclosures of this patent are incorporated herein by reference.

An undesirable aspect common to both of the spacer assemblies discussed above is that the metal spacer member extends essentially entirely between outer glazing sheets 24 and thus transmits heat or cold directly through the edges of the insulating glazing unit. This transmission reduces the insulating effectiveness of the glazing unit because metal is an excellent transmitter of heat and cold. Sealant 22 on the sides of spacer 10 does not create enough of a thermal break between the glass and the metal to be an effective insulator. It is thus desired in the art to provide a spacer assembly that uses one of the spacer assemblies discussed above in combination with another spacer element to create an assembly that provides an insulating member between the metal spacer member and the glazing sheets to improve the overall insulating properties of the insulating glazing unit.

An undesirable aspect of the INTERCEPT® spacer is that a flowable desiccant matrix must be pumped into the interior of the spacer after the spacer is formed. The pumping operation increases the cost of fabricating the spacer. In addition, the flowable desiccant causes the pumps to wear rapidly requiring the pumps to be frequently maintained or replaced. The art desires a method of adding the desiccant to the spacer assembly that avoids the cost of the pumps.

Two other prior art spacer assemblies are depicted in FIGS. 3 and 3A. The spacer assembly 30 depicted in FIG. 3 has been sold under the trademark SUPER U™ by Edgetech I.G. Inc. of Cambridge, Ohio, the assignee of the present application. The SUPER U™ spacer assembly 30 includes a preformed foam spacer member 32 that carries a preformed metal spacer member 34. The spacer assembly is assembled by first forming a frame from the metal spacer member and then cartwheeling the frame into the foam. The foam-metal assembly then must be cartwheeled again to add the adhesive 36 to the outside of foam spacer member 32 before it is sandwiched between glazing sheets 24. A sealant 38 is then added to the sealant channel formed outside foam spacer member 32 and glazing sheets 24.

The prior art spacer assembly 40 depicted in FIG. 3A is similar to spacer assembly 30 but is used to hold a delicate, center-lite art glass between a pair of outer glazing sheets 24. Spacer assembly 40 also has been sold under the trademark CUSHION EDGE by Edgetech I.G. Inc. of Cambridge, Ohio, the assignee of the present application. The foam spacer member 42 is extruded in its final shape during manufacture and must be sized to fit the art glass 44 and to form the desired spacing between glazing sheets 24. A layer of pressure sensitive adhesive 46 is disposed in the U-channel to hold the position of the art glass 44. Spacer assembly 40 further includes a vapor barrier 48 and sections of adhesive 49 that connect assembly 40 to glazing sheets 24.

Although spacer assemblies 30 and 40 are functional, it is difficult to retrofit an existing automated INTERCEPT® spacer assembly line to create either spacer assembly 30 or 40. The cartwheeling assembly process is time consuming and includes too many manual steps to be easily automated. It is thus desired in the art to provide a nonmetallic, desiccant-carrying spacer member that may be combined with a first spacer member (such as the metal spacer frame segments from the Glass Equipment Development linear system or the metal INTERCEPT® spacer member) to form a spacer assembly that eliminates metal-to-glass contact. It is particularly desirable to provide such a spacer assembly that may be fabricated in a linear arrangement to custom lengths so that the spacer assembly may be simply folded into a frame and used to form the glazing unit.

BRIEF SUMMARY OF THE INVENTION

The invention provides a spacer assembly and a method for fabricating the assembly wherein the spacer assembly includes an inner spacer member and an outer spacer member. The outer spacer member carries the desiccant for the insulating glazing unit. In one embodiment of the invention, the desiccant is carried by a structural foam element disposed on the outside of an inner spacer member. The foam element may be provided in a wrap or in strips of foam disposed on the sides of a rigid inner spacer member. In another embodiment of the invention, the desiccant is provided in the form of a low permeable desiccant matrix disposed on the outer surfaces of an inner spacer member. This element may be gunned directly onto the inner spacer member.

The invention also provides a method for forming a spacer assembly wherein the spacer assembly is linearly fabricated and then folded into a frame that is ready to be positioned between a pair of glazing sheets and run through a heated roller press to form the insulating glazing unit. The width of the spacer assembly may be adjusted by varying the width of the inner spacer member or the outer spacer member. In order to linearly fabricate the spacer assembly, an outer spacer member is joined with an inner spacer member before the inner spacer member is folded into a frame.

The invention also provides a method for fabricating a spacer assembly for an insulating glazing unit wherein an outer spacer member is wrapped from a flat configuration to a wrapped configuration around an inner spacer member.

One embodiment of the invention provides an outer spacer member that is wrapped around an inner spacer member to form the spacer assembly that is used to space glazing sheets in an insulating glazing unit. The invention provides different versions of the wrappable outer spacer member including embodiments where the outer spacer member is provided in a sheet.

The invention also provides a method for fabricating a spacer assembly for an insulating glazing unit wherein the outer spacer member is cut to width from a sheet of outer spacer member material.

The invention also provides an embodiment wherein a portion of the spacer assembly extends across the inwardly-facing surface of the inner spacer member to block the inner spacer member from view. In another embodiment, the portion that extends across the inwardly-facing surface of the inner spacer member holds and positions the edge of an intermediate glazing sheet.

BRIEF DESCRIPTION OF THE SEVERAL VIEWS OF THE DRAWINGS

Similar numbers refer to similar elements throughout the specification.

DETAILED DESCRIPTION OF THE INVENTION

Figure 1:
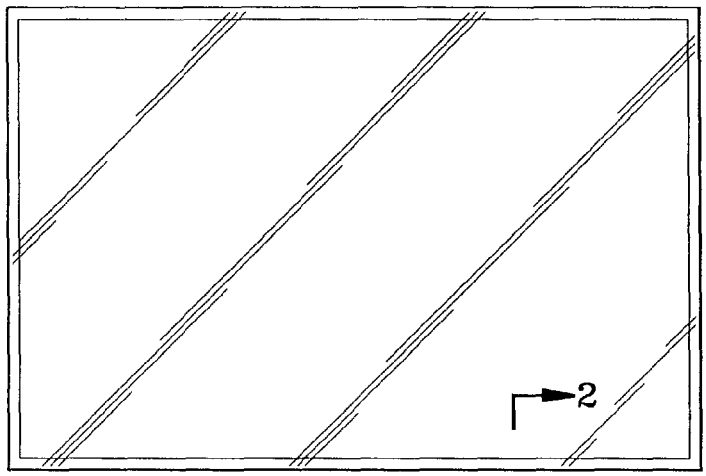
FIG-1 PRIOR ART
FIG. 1 is an elevation view of an exemplary prior art insulating glazing unit.

A first embodiment of an outer spacer member made in accordance with the concepts of the present invention is indicated generally by the numeral 50 in the accompanying drawings. In the preferred embodiments of the present invention, outer spacer member 50 is primarily fabricated from a foam material such as silicone foam or EPDM. In other embodiments, spacer member 50 may be fabricated from other non-metallic materials that have relatively low thermal conductivity. Outer spacer member 50 is combined with inner spacer member 10 to form the spacer assembly 64 of the present invention. Although the drawings show one exemplary embodiment of inner spacer member 10, inner spacer member 10 may be provided in a wide variety of different shapes that may be fabricated in different manners. For instance, inner spacer member 10 may be an extruded or roll formed tube having a square, rectangular, rounded, or triangular cross section. The inner spacer member may be fabricated from any of the variety of materials known in the art.

In the exemplary embodiment, inner spacer member 10 includes bottom wall 12 from which extend sidewalls 14 from each edge of bottom wall 12. Sidewalls 14 terminate in upper or inner ends. In some embodiments, flanges 16 project from each end toward each other and substantially parallel to bottom wall 12. Flanges 16 increase the stiffness of spacer member 10 and help form a cold air trap as will be described in more detail below. In the preferred embodiment of the present invention, inner spacer member 10 is fabricated from a metal. In other embodiments, inner spacer member 10 may be fabricated from other materials such as a rigid plastic or an oriented plastic.

In the first embodiment, outer spacer member 50 includes a layer of foam 52 that carries a desiccant material. An adhesive, such as a pressure sensitive adhesive 54, is mounted on the inner surface 56 of foam 52. Foam 52 may have a pair of stress-relief areas 58 that allow foam 52 to easily fold when it is wrapped about the outside surface of inner spacer member 10. Layer 52 may also be fabricated from a material that may be folded and laminated without areas 58. These materials may be provided with bending characteristics that prevent delamination. In other embodiments, adhesive 54 is sufficiently strong to resist the memory of the foam.

Outer spacer member 50 may be fabricated and stored in long lengths (such as coiled reels of material) and then joined with inner spacer member 10 and cut to the desired length during the assembly process. The structure of outer spacer member 50 lends itself to use in an automated assembly process. When outer spacer member 50 is used with an inner spacer member that is not continuously roll formed, the connection of the outer spacer member to the inner spacer member before the frame is fabricated eliminates the prior art step of cartwheeling an assembled frame into the outer spacer member. The final spacer assembly 64 that is created when outer spacer member 50 is wrapped about inner spacer member 10 is used to form an insulating glazing unit lacking any direct contact between the glass 24 and inner spacer member 10. Such isolation is especially important when inner spacer member 10 is fabricated from metal as in many prior art spacer assemblies.

In the first embodiment of the present invention, each stress-relief area 58 is a continuous and longitudinal notch formed in inner surface 56. Notches 58 are spaced apart by a distance that is substantially equal to the width of bottom wall 12 of inner spacer member 10 such that they are aligned with the corners. Outer spacer member 50 is formed with a width sufficient to substantially cover the outer surface of inner spacer member 10 when outer member 50 is wrapped about inner member 10. The area of member 50 disposed between notches will be referred to as the base 60 of outer spacer member 50 with the portions on either side of base 60 being referred to as the legs 62. Body 60 is configured to extend entirely across bottom wall 12 of metal spacer member 10. Each leg 62 is sized to extend entirely up each side wall 14 of spacer member 10. Thus, when outer spacer member 50 is wrapped about the outside of inner spacer member 10 to form spacer assembly 64 (depicted in FIG. 5) each leg 62 extends substantially to flange 16.

Outer spacer member 50 may also include a moisture-vapor barrier 66 disposed on the outside surface of foam 52. In the first embodiment of the invention, barrier 66 may extend across the entire width of body 60 and legs 62. A sealant 68 is disposed on the outside surface of barrier 66. Sealant 68 may be any one of a variety of adhesives known in the art (such as hot-melt butyl) that provide a moisture-vapor barrier when adhered to a glass surface.

Outer spacer member 50 is sized to cooperate with inner spacer member 10 to space two glazing sheets 24 apart a desired distance. The distance is determined by the width of inner spacer member 10 and the thickness of outer spacer member 50. The designer of the glazing unit must initially select the desired proportions of inner and outer spacer members. In some situations, it may be desirable to minimize the amount of material (such as the cost of the metal) used to form the inner spacer member. In other situations, it may be desirable to minimize the amount of material (such as the cost of the foam) used in the outer spacer member. Either situation or a compromise between the two extremes may be accomplished by selectively sizing outer spacer member 50 and inner spacer member 10.

When inner spacer member 10 is fabricated by roll forming metal into the desired configuration, it is known in the art that the width of inner spacer member 10 may be adjusted by adjusting the set up of the automated equipment that roll forms flat metal stock into inner spacer member 10. It is also known that it is undesirable to change the machinery set up because each changes requires down time and wasted material. Outer spacer member 50 of the present invention gives a manufacturer the ability to set the metal forming machinery at a single setting and run the machinery continuously to produce metal inner spacer members 10. Outer spacer members 50 may then be used by the manufacturer to fabricate a spacer assembly 64 of a desired width simply by selecting a foam spacer member 50 that forms the desired dimension when wrapped about member 10. This practice allows the manufacturer to maximize its use of the roll forming equipment and minimize the cost of the metal (if desired) while having the capability of providing spacer assemblies 64 of varying sizes. In addition, glazing units fabricated with spacer assembly 64 eliminate the undesirable metal-to-glass contact.

The desiccant material of spacer assembly 64 is positioned between inner spacer member 10 and glazing sheets 24 when spacer assembly 64 is used to form an insulating glazing unit. The desiccant is thus positioned directly in the tortuous path that moisture must follow to enter the sealed cavity of the glazing unit. In the past, the desiccant was positioned inside inner spacer member 10. This position allowed moisture to enter the cavity before encountering the desiccant. An advantage of this design is that any moisture passing through spacer assembly 64 will contact the desiccant before entering the sealed cavity.

Figure 5:
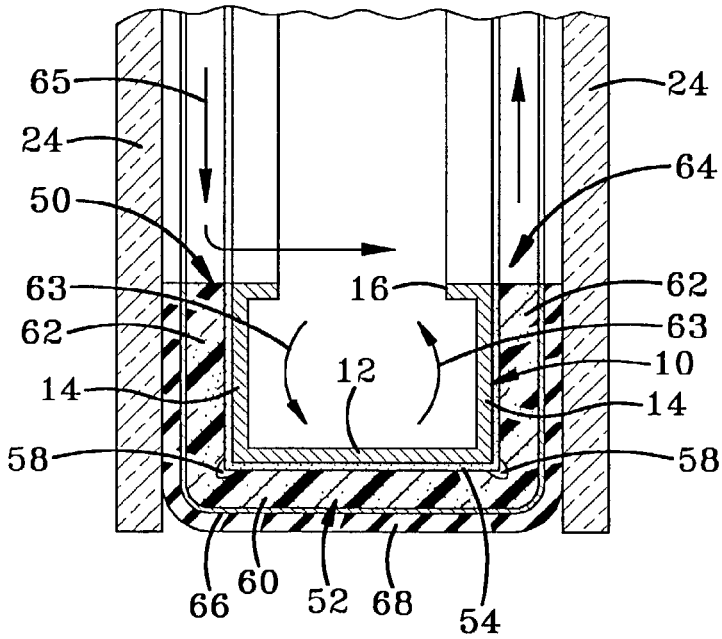
FIG. 5 is a sectional end view of the first embodiment of the spacer assembly of the present invention positioned between first and second glazing sheets.

Spacer assembly 64 of FIG. 5 has desired insulating characteristics not only because glazing sheets 24 are isolated from one another by a nonmetallic material of low thermal conductivity but also because inner spacer member 10 forms a cold air trap. The open channel configuration of inner spacer member 10 traps the coldest air (as indicated by the numeral 63) in the glazing unit as the cooler air 65 falls along the colder glazing sheet 24. The coldest air 63 of the glazing unit becomes trapped in inner spacer member 10 where it is substantially surrounded by the insulting nonmetallic material of outer spacer member 50.

Figure 2:
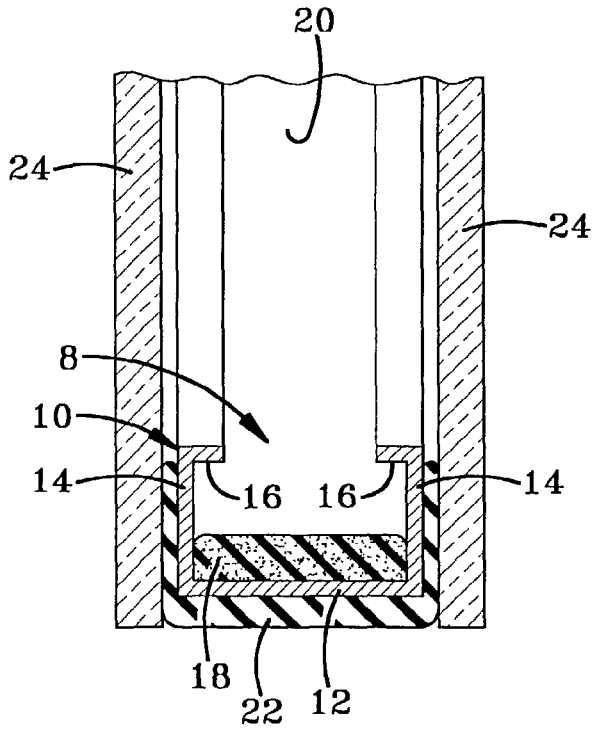
FIG-2 PRIOR ART
FIG. 2 is a section view of a prior art spacer assembly taken along line 2-2 of FIG. 1.
Figure 3:
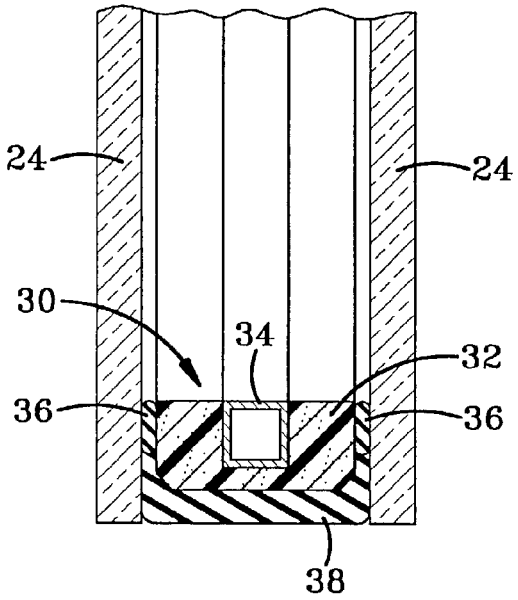
FIG-3 PRIOR ART
FIG. 3 is a section view similar to FIG. 2 of another prior art spacer assembly.
Figure 3A:
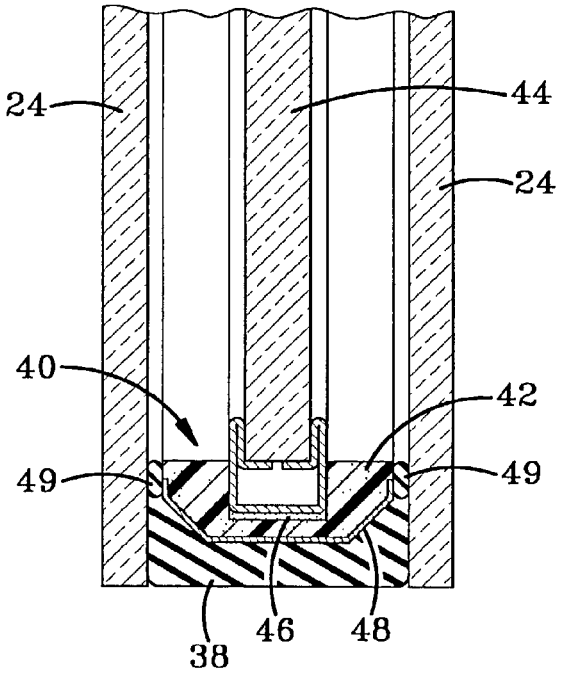
FIG-3A PRIOR ART
FIG. 3A is a section view similar to FIGS. 2 and 3 of a further prior art spacer assembly used to form a glazing unit having an intermediate glazing sheet.
Figure 4:
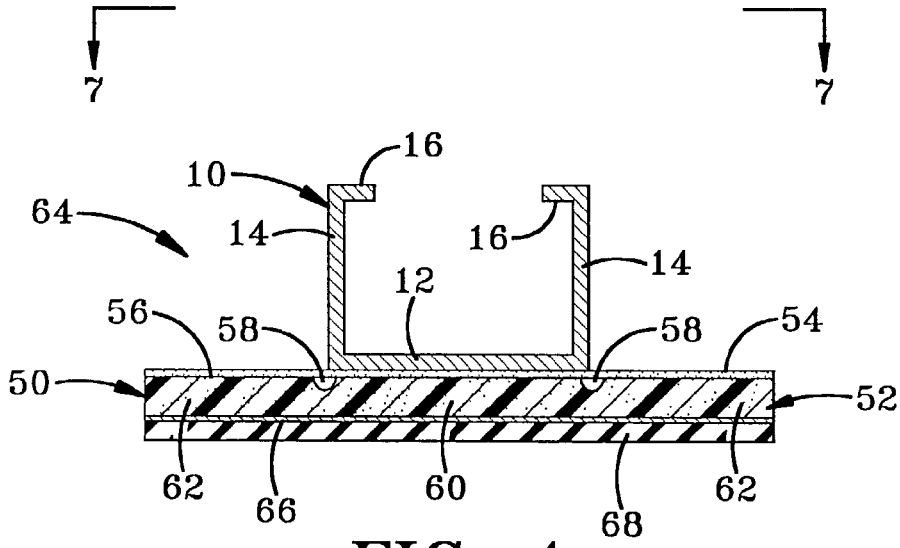
FIG. 4 is a sectional end view showing a first embodiment of the outer spacer member of the present invention initially positioned with respect to an inner spacer member.

In addition to the cold air trap and the elimination of metal-to-glass contact, spacer assembly 64 better accommodates temperature and pressure changes and forces such as blowing wind that cause glazing sheets 24 to move and stress the seal between spacer assembly 64 and glazing sheets 24. In the past, such movement had to be accommodated by sealant 22 as shown in FIG. 2. In the present invention, the nonmetallic material of legs 62 may be configured to flex more readily than sealant 68 such that legs 62 accommodate movement of glazing sheets 24. Such accommodation lengthens the life of the seal between glazing sheets 24 and spacer assembly 64.

Another advantage to this design is that the desiccant is added to the spacer assembly with the cost of desiccant pumps and the associated costs of running the pumps.

Figure 6:
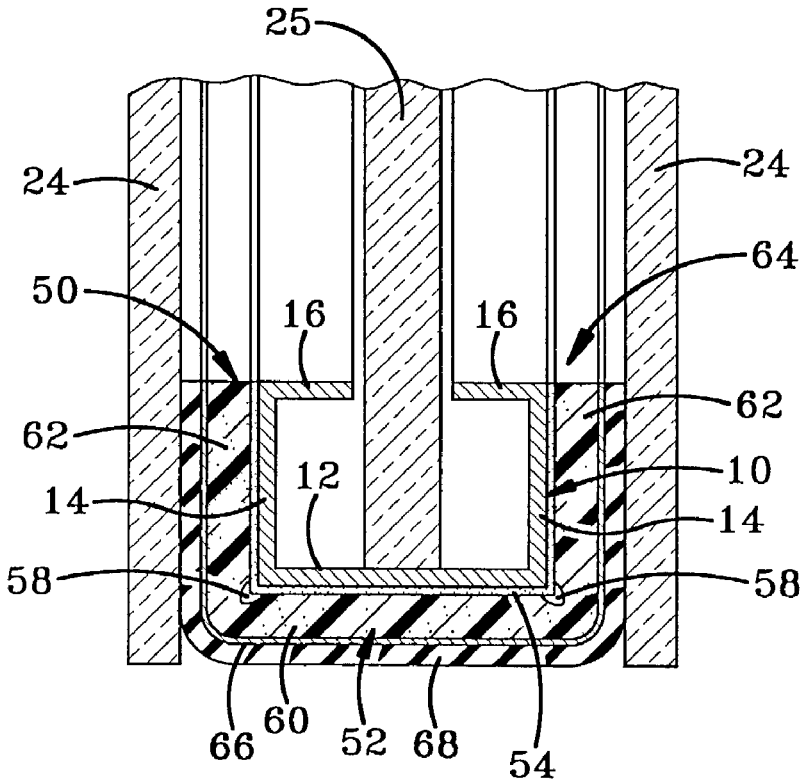
FIG. 6 is a view similar to FIG. 5 showing how the spacer assembly of the present invention can be used to hold an intermediate glazing sheet.

Spacer assembly 64 may also be used to hold an intermediate glazing sheet 25 as depicted in FIG. 6. Flanges 16 may be larger in this configuration in order to hold intermediate sheet 25 in position. An advantage to this design is that a flowable desiccant matrix is not disposed on the inside of spacer 10 so that the edge of sheet 25 does not stick in the desiccant.

Figure 29:
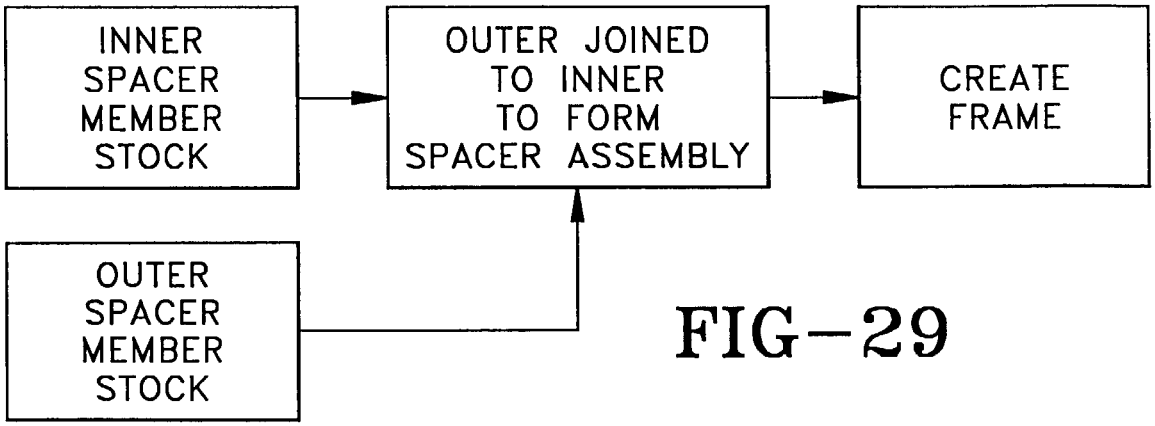
FIGS. 29 and 30 are flow charts showing examples of how the outer spacer member of the present invention is combined with an inner spacer member in an automated assembly line.
Figure 30:
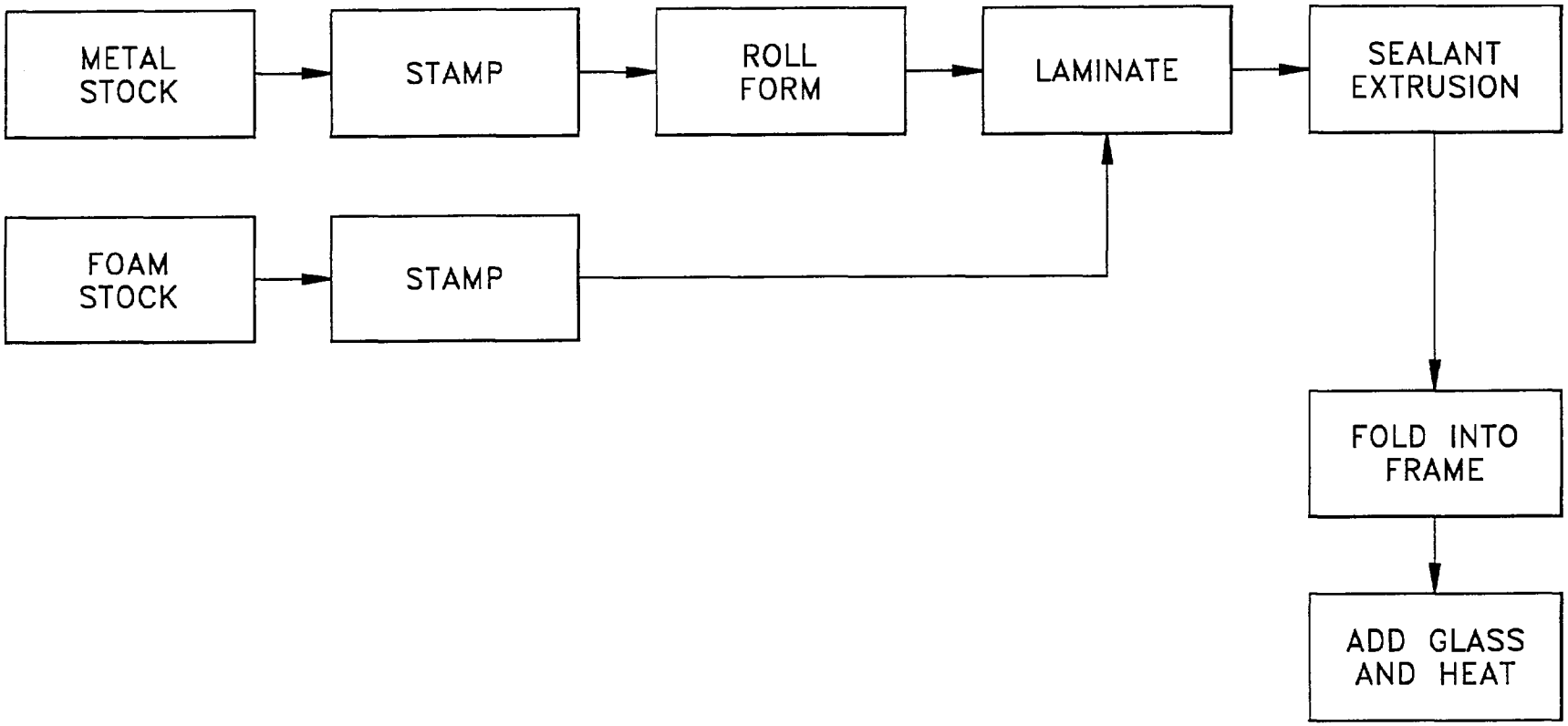

Outer spacer member 50 may be joined to inner spacer member 10 in an automated manufacturing line that wraps member 50 around member 10. Member 50 may be notched before it is joined with member 10. In the past, member 10 is notched and then roll formed into its final shape. The method of the present invention notches outer spacer member 50 and then joins it with inner spacer member 10 to form assembly 64. A flow chart of an example of this process is depicted in FIG. 29. In another embodiment of the invention, the outer spacer member is joined to the inner spacer member and the combination of materials are formed into the spacer shape. When the inner spacer members are connected with corner elements, the method of the invention causes the outer spacer member to be connected to the inner spacer member before the frame is assembled so that the outer spacer member does not have to be connected to an assembled frame.

Figure 8:
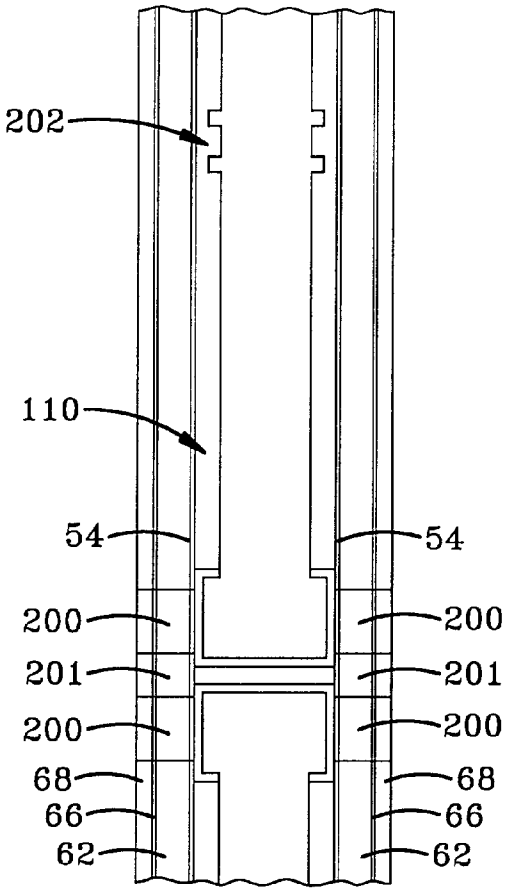
FIG. 8 is a view similar to FIG. 7 with the outer spacer member wrapped about the inner spacer member.
Figure 7:
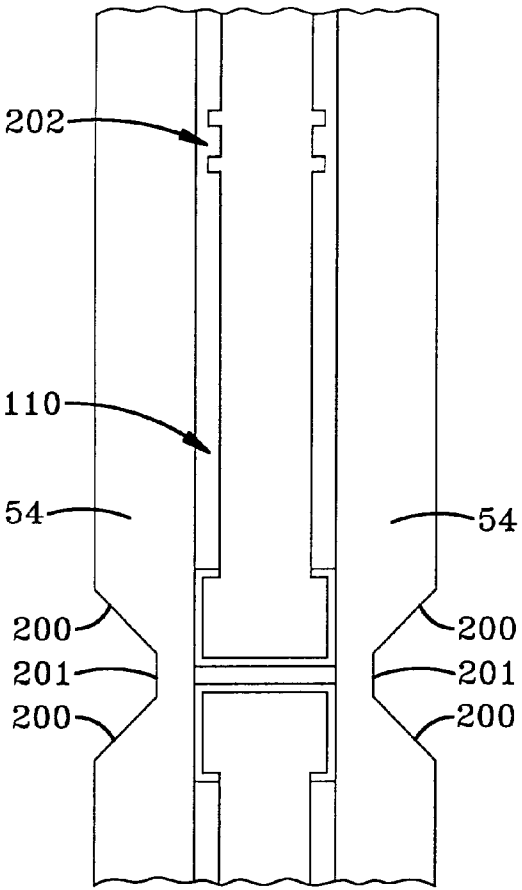
FIG. 7 is a top plan view taken along line 7-7 of FIG. 4 showing an area of the spacer that will form a corner with the outer spacer member disposed in a flat configuration.

The automated equipment can automatically locate and punch the cuts 200 and 201 that form the corners and automatically position and punch the holes 202 for the muntin clips 204. (See FIGS. 7-9) These operations are currently performed on metal spacer members and it is desirable that the same operations be performed for spacer assembly 64.

Figure 9:
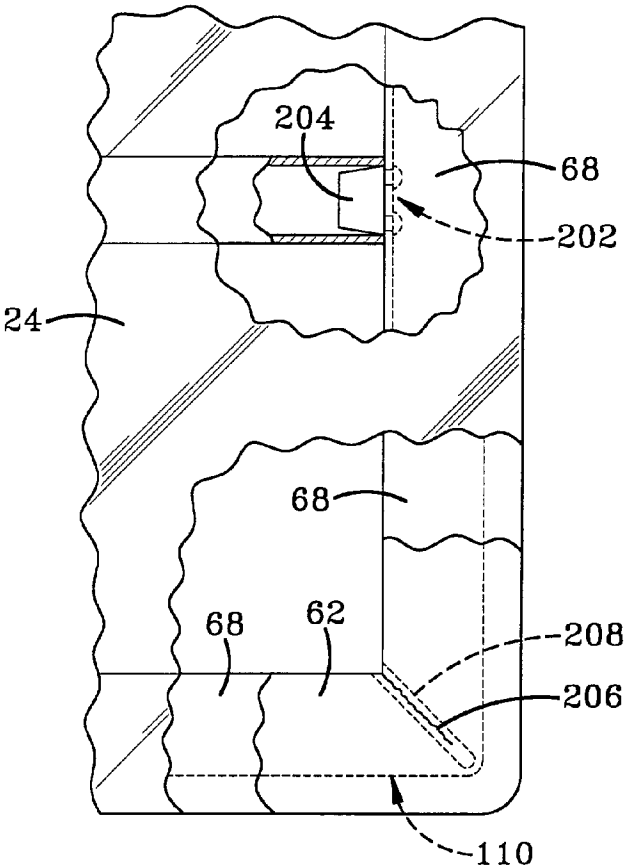
FIG. 9 is a side view showing a corner of the spacer assembly after it has been folded into a frame and assembled into an insulating glazing unit.

The corners of outer spacer member 50 are undercut so that edges 200 compressively engage each other (as indicated by the numeral 206) when the corners are folded up into the 90 degree corners as depicted in FIG. 9. The configuration of the corners provide support to adhesive 68 on the outside of the corners over the gaps 208 that are formed in the corners of inner spacer member 10. Adhesive 68 is important in the corners because the material of inner spacer member 10 does not provide a moisture barrier because of the gap.

Spacer assembly 64 may be fabricated by automatically attaching outer spacer member 50 with inner spacer member 10 after the elements have been formed and punched. The attachment is achieved by contacting inner spacer member 10 with the inner face of body 60 of outer spacer member 50. Adhesive 54 holds the two elements in position until legs 62 are wrapped up against legs 14 of inner spacer member 10. Once assembled and in use, spacer assembly 64 positions the desiccant outside of the inner spacer member 10 and directly in the tortuous path through which moisture must pass to enter the sealed cavity of the glazing unit.

Figure 10:
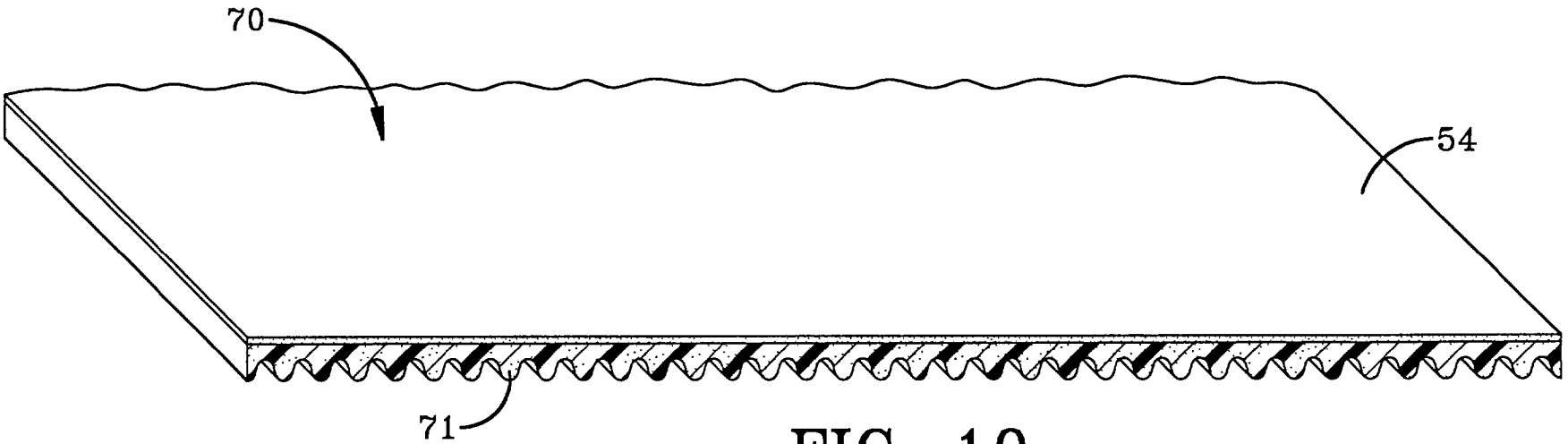
FIG. 10 is perspective view of a portion of a sheet of material that is used to form the outer spacer members according to a second embodiment of the invention.
Figure 11A:
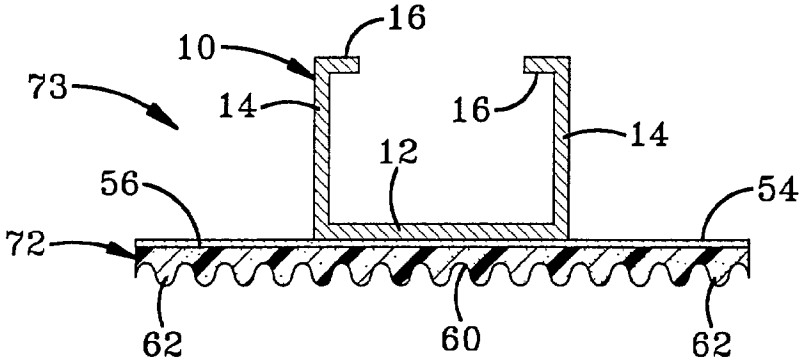
FIGS. 11A, 11B, and 11C are sectional end views of strips of material cut from the sheet depicted in FIG. 10 positioned with respect to different-sized inner spacer members.
Figure 11B:
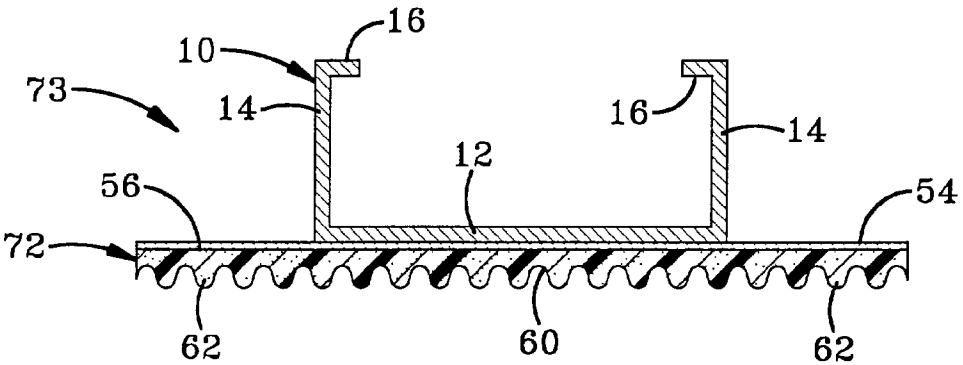
Figure 11C:
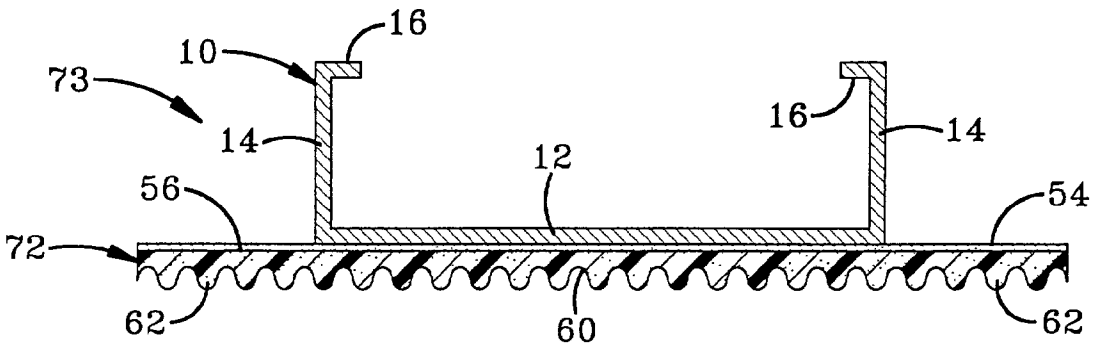
Figure 12A:
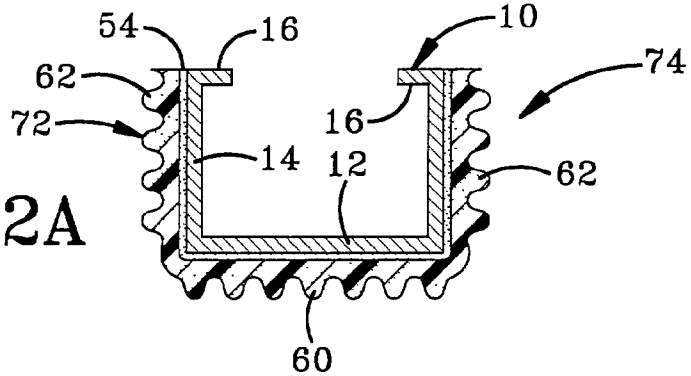
FIGS. 12A, 12B, and 12C are sectional end views of the strips of material depicted in FIGS. 11A, 11B, and 11C wrapped around the different-sized inner spacer members.
Figure 12B:
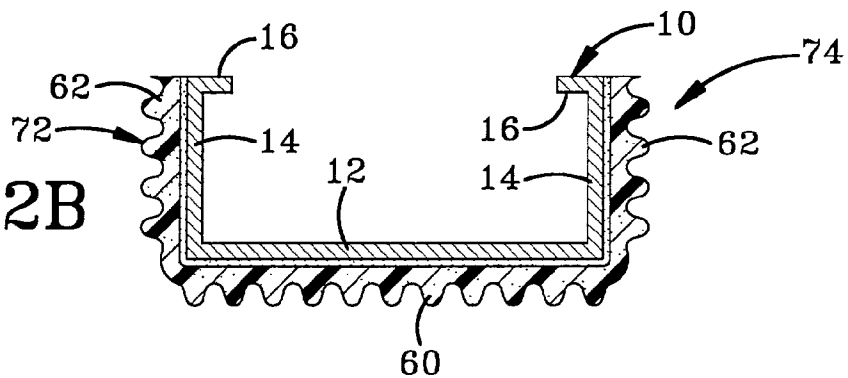
Figure 12C:
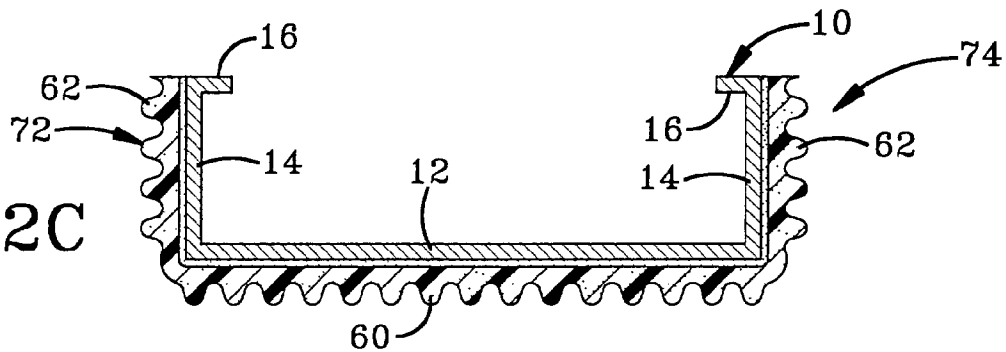

A second embodiment of the present invention is depicted in FIGS. 10-12. The second embodiment of the outer spacer member is formed in a sheet 70 as shown in FIG. 10. Sheet 70 includes a corrugated foam layer 71 that has a layer of adhesive 54 disposed on its inner planar surface. Foam layer 71 is preferably extruded in the corrugated shape such that the corrugations are longitudinal and continuous along the length of sheet 70. Layer 71 may be fabricated from the same type of foam material as described above with respect to the first embodiment of the invention. Layer 71 also carries a desiccant.

Sheet 70 is used to form spacer assemblies by first determining the desired width of the spacer assembly. After a width is established, metal spacer member 10 is formed with a width equal to the desired width of the spacer assembly less twice the thickness of sheet 71. A strip 72 is then cut from sheet 70 at a width equal to the width of inner spacer member 10 plus the height of both sidewalls 14 thus forming base 60 and legs 62 as described above. Inner spacer member 10 is then positioned longitudinally on the top of strip 72 and adhesive 54 holds the two elements together. This combination is indicated by the numeral 73 in FIGS. 11A-11C. The only difference between the versions depicted in FIGS. 11A-11C is the widths.

Combinations 73 are formed into spacer assemblies 74 by wrapping strips 72 about inner spacer members 10 such that adhesive 54 holds legs 62 in place about the outer surface of member 10. The corrugations provide the areas of reduced thickness that function as the stress relief areas. The advantage of using the corrugated shaped is that the stress relief areas do not have to be specifically positioned with respect to member 10. The space between each corrugation is small enough such that an area of reduced thickness is always close to an edge or corner of bottom wall 12 when strip 72 is wrapped around member 10.

Spacer assemblies 74 may then be used to form an insulating glazing unit similar to the unit depicted in FIG. 1 by gunning an adhesive (such as hot melt butyl) along the exposed corrugated sides of foam 71. The spacer assembly having the adhesive is then positioned between two glazing sheets 24 and passed through a heated roller press to wet out the adhesive onto the glass. The corrugations help maintain the position of the adhesive between foam 71 and the glass.

Figure 13:
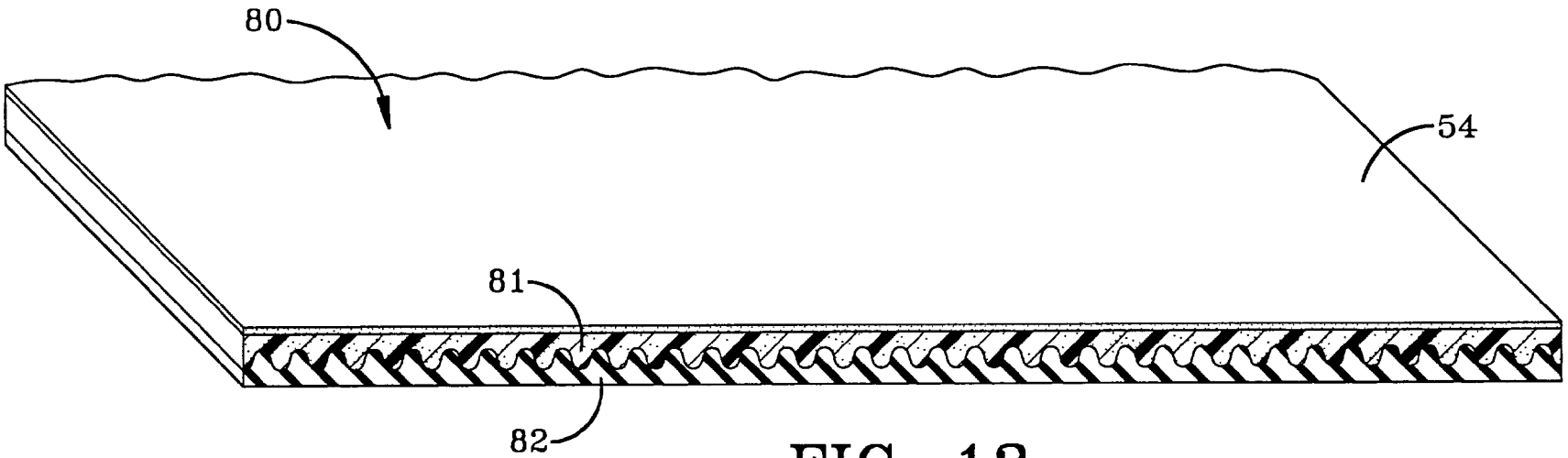
FIG. 13 is perspective view of a portion of a sheet of material that is used to form the outer spacer members according to a third embodiment of the invention.
Figure 14A:
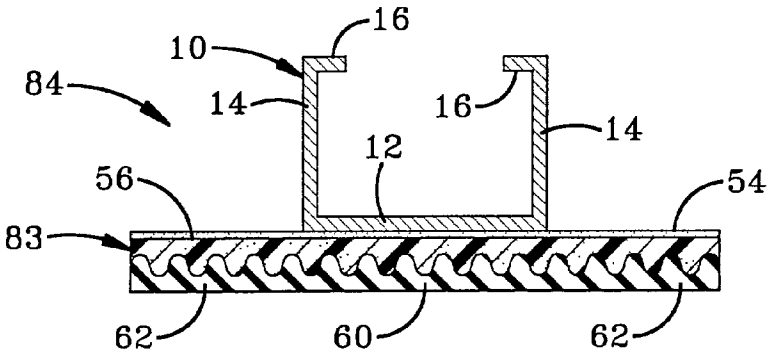
FIGS. 14A, 14B, and 14C are sectional end views of strips of material cut from the sheet depicted in FIG. 13 positioned with respect to different-sized inner spacer members.
Figure 14B:
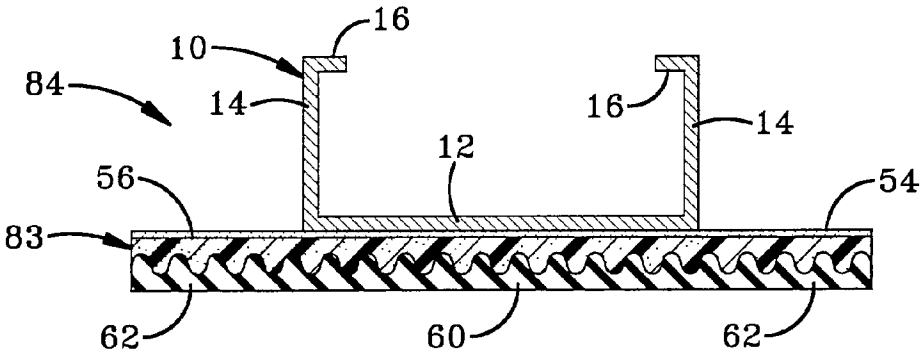
Figure 14C:
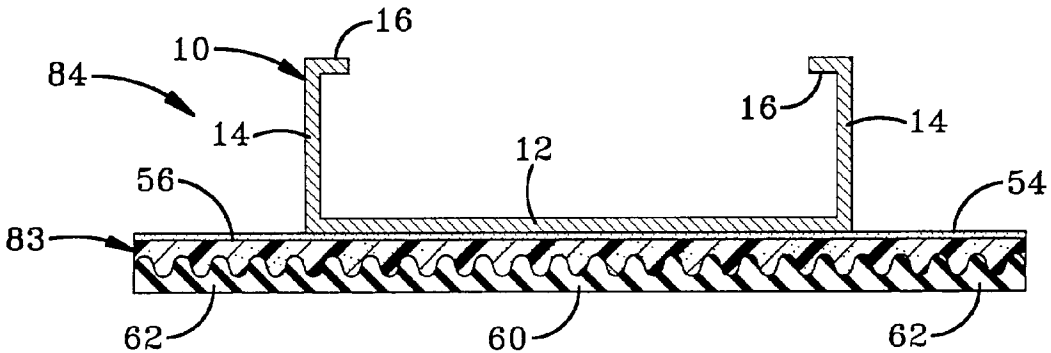
Figure 15A:
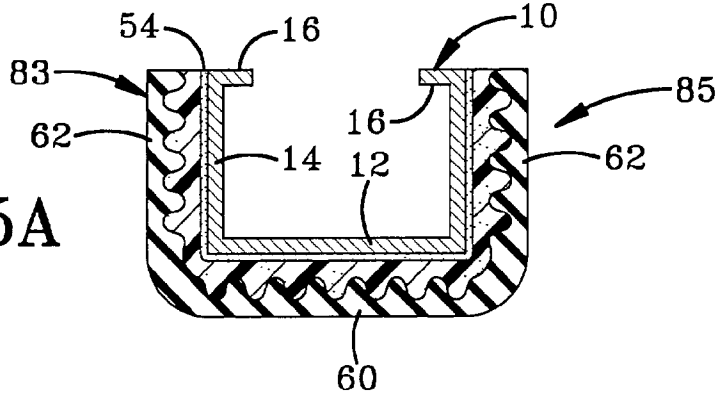
FIGS. 15A, 15B, and 15C are sectional end views of the strips of material depicted in FIGS. 14A, 14B, and 14C wrapped around the different-sized inner spacer members.
Figure 15B:
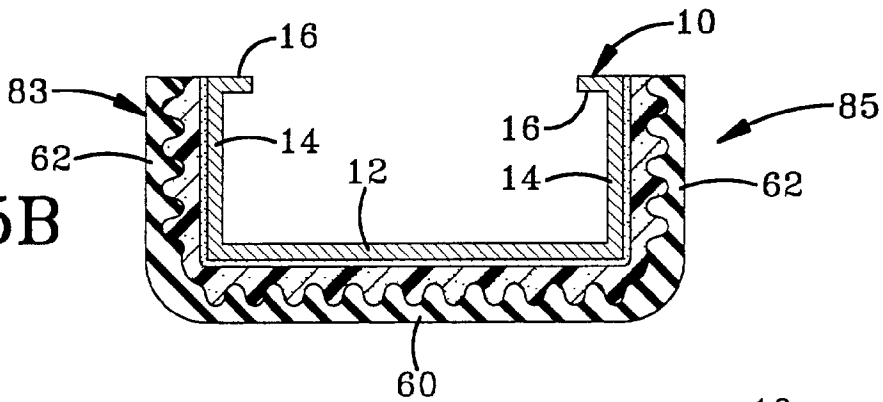
Figure 15C:
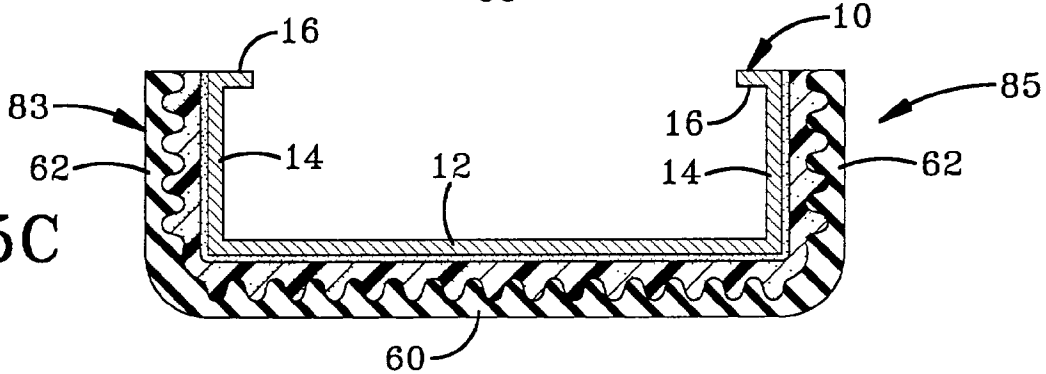
Figure 16:
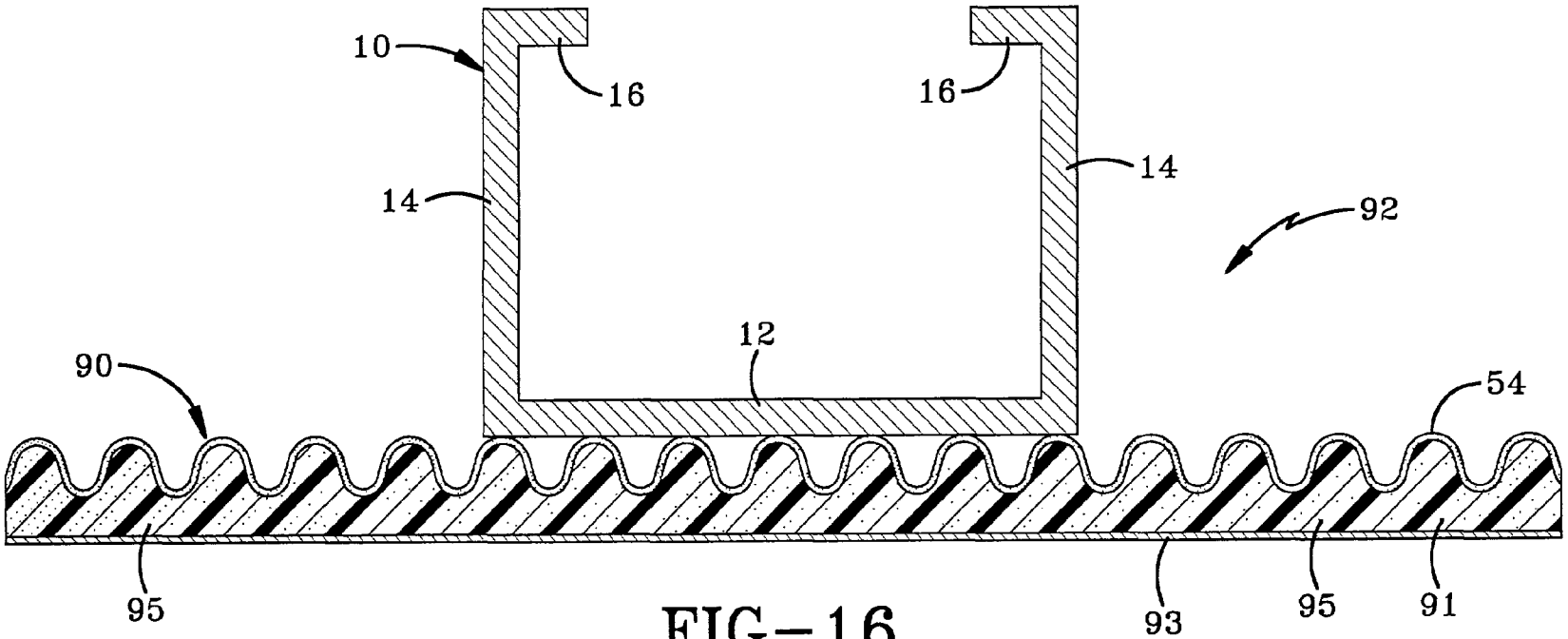
FIG. 16 is a sectional end view of a fourth embodiment of the outer spacer member positioned with respect to the inner spacer member.
Figure 17:
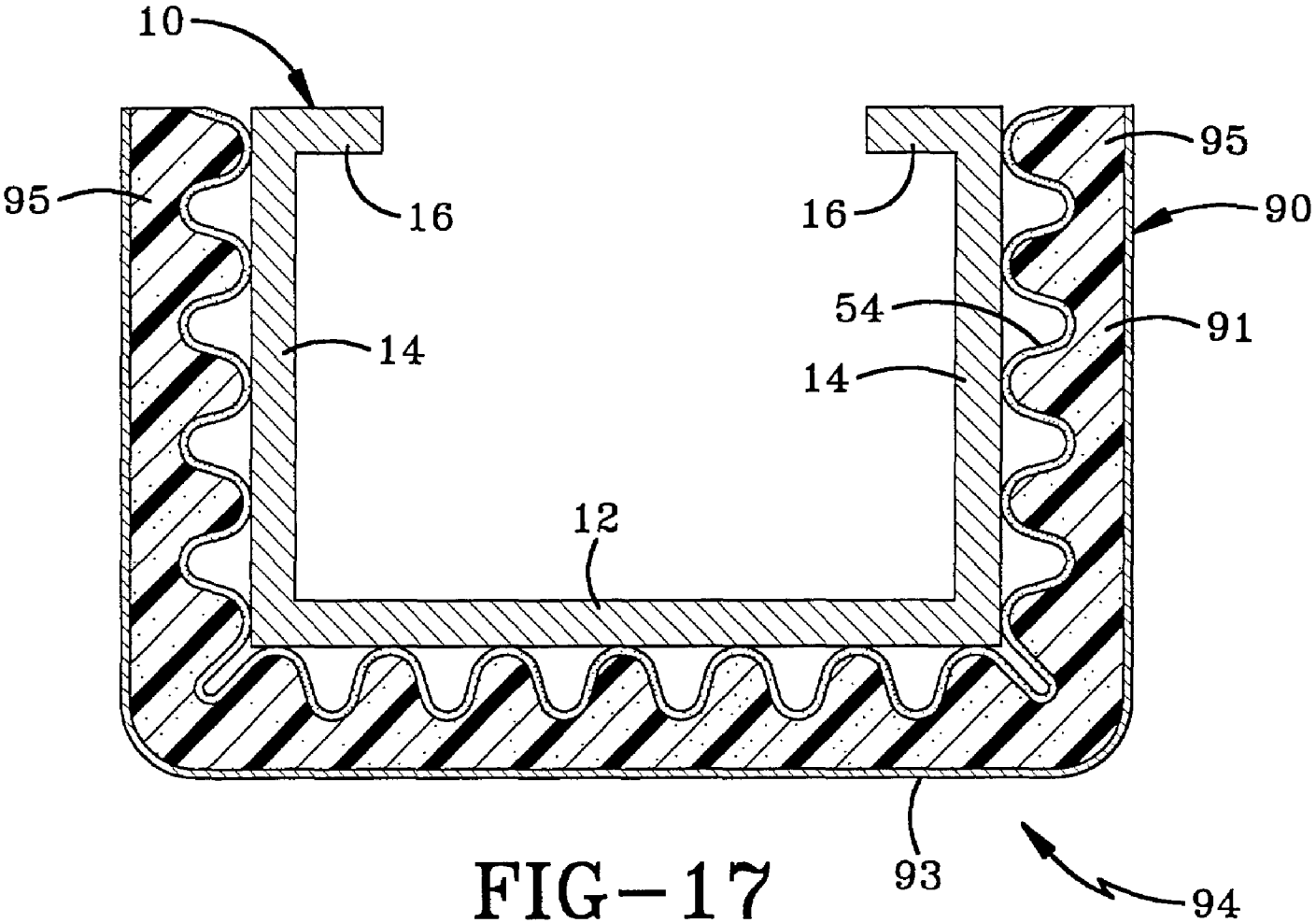
FIG. 17 is a sectional end view of the fourth embodiment of the outer spacer member wrapped around the inner spacer member.
Figure 18:
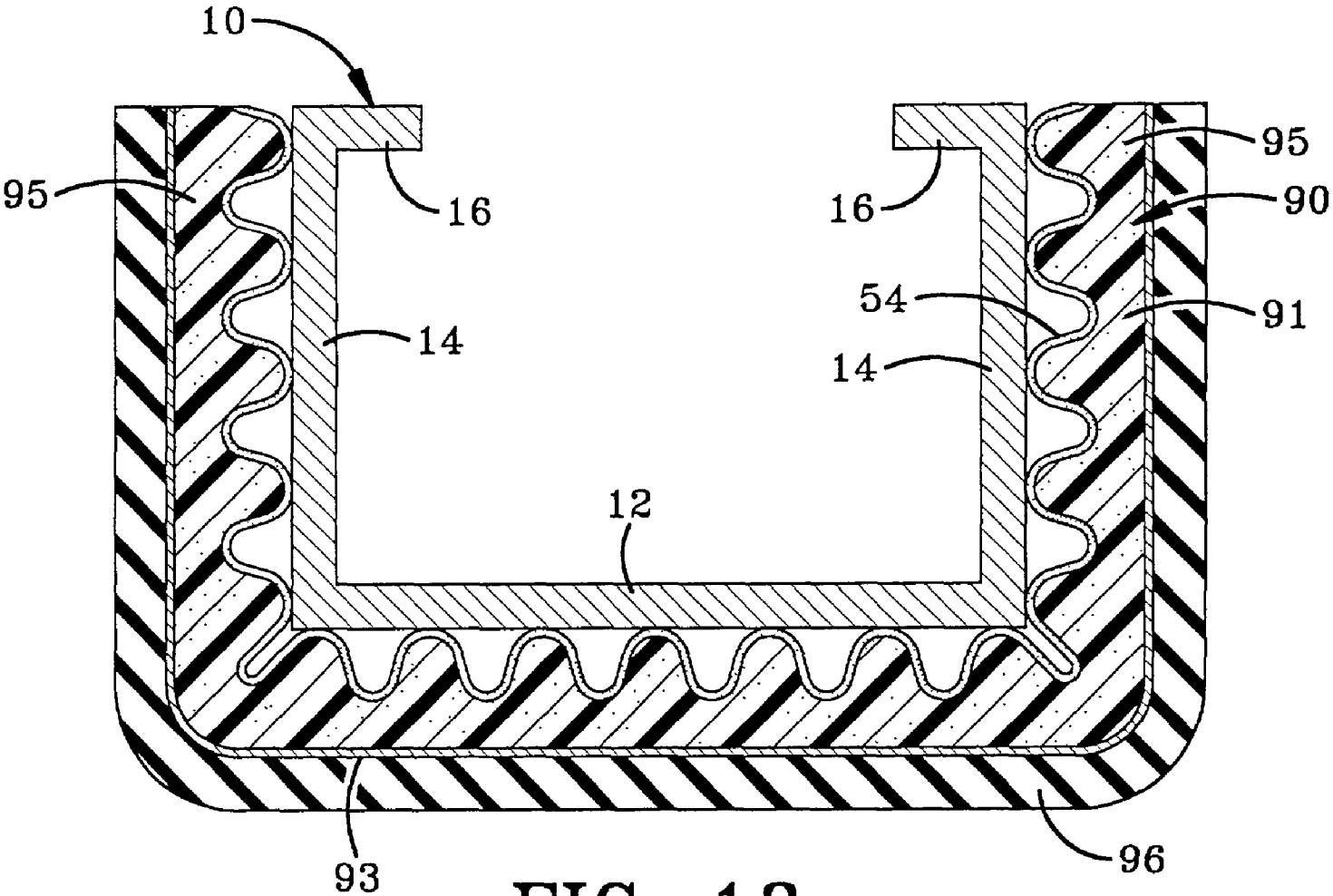
FIG. 18 is a sectional end view of the fourth embodiment of the spacer assembly.
Figure 19:
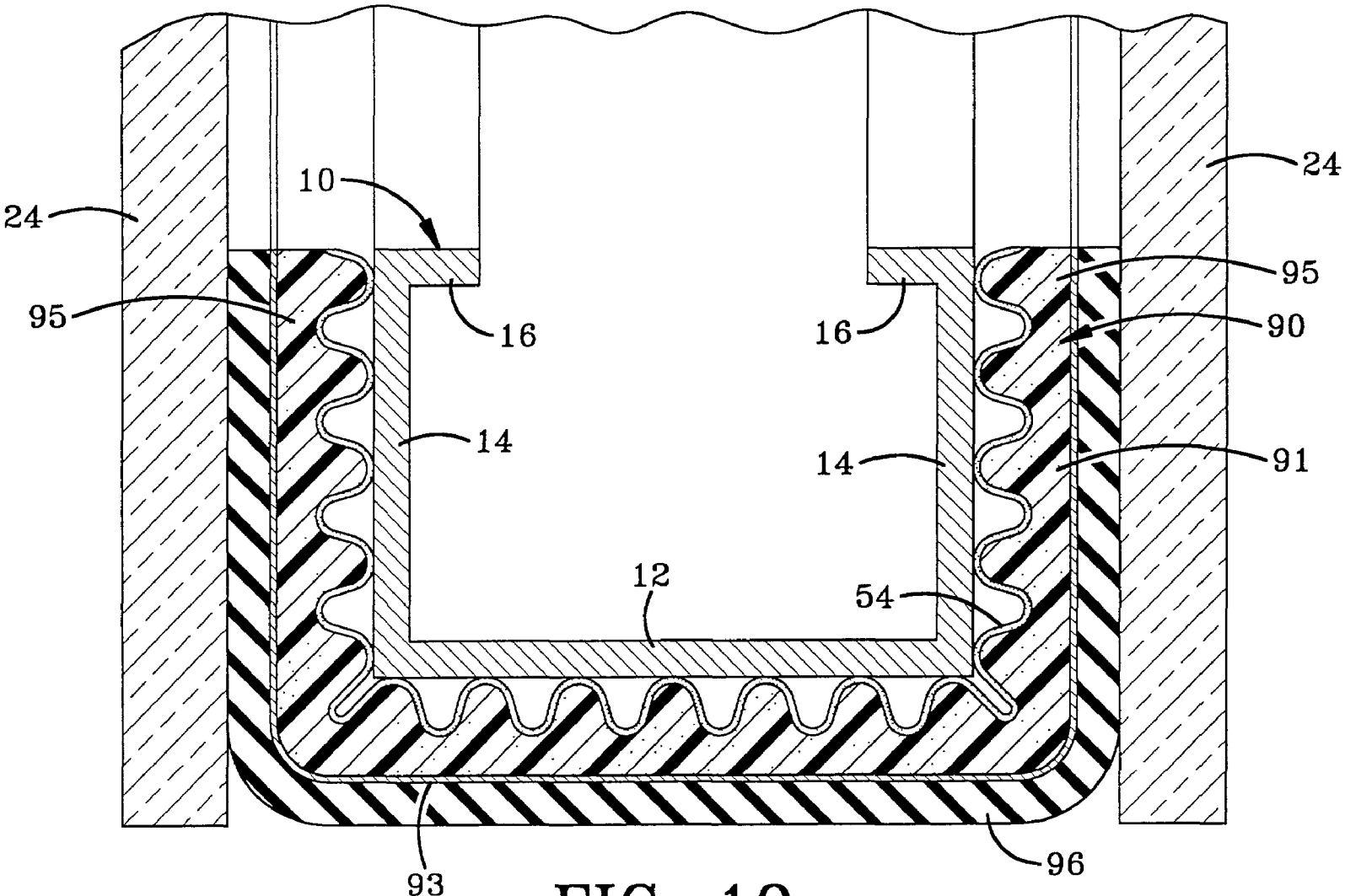
FIG. 19 is a sectional end view of the fourth embodiment of the spacer assembly positioned between first and second glazing sheets.

A third embodiment of the present invention is depicted in FIGS. 13-15. The third embodiment of the outer spacer member is formed in a sheet 80 as shown in FIG. 13. Sheet 80 includes a corrugated foam layer 81 that has a layer of adhesive 54 disposed on its inner planar surface. The outer surface of layer 81 is coated with an adhesive 82 such as a hot melt butyl.

Foam layer 81 is preferably extruded in the corrugated shaped such that the corrugations are longitudinal and continuous along the length of sheet 80. Layer 81 may be fabricated from the same type of foam material as described above with respect to the first embodiment of the invention. Layer 81 also carries a desiccant material.

Sheet 80 is used to form spacer assemblies in the same manner as described above with respect to sheet 70. The difference is that the strips 83 used to form the combinations 84 and then spacer assemblies 85 are pre-coated with adhesive 82. Spacer assemblies 85 are thus ready to be used to form insulating glazing units as soon as strips 83 are cut to size and wrapped around member 10.

A fourth embodiment of an outer spacer member made in accordance with the concepts of the invention is indicated generally by the numeral 90 in FIGS. 16-19. Outer spacer member 90 may be formed in a sheet and cut to width as described above with respect to the second and third embodiments of the invention. Outer spacer member 90 includes a corrugated foam layer 91 that has a layer of adhesive 54 disposed on its inner corrugated surface. Foam layer 91 is preferably extruded in the corrugated shape such that the corrugations are longitudinal and continuous. Layer 91 may be fabricated from the same type of foam material as described above with respect to the first embodiment of the invention. Layer 91 also carries a desiccant. Outer spacer member 90 may further include a moisture-vapor barrier 93.

To form the fourth embodiment of the spacer assembly of the invention, inner spacer member 10 is positioned longitudinally on the top of outer spacer member 90 and adhesive 54 holds the two elements together. This combination is indicated by the numeral 92 in FIG. 16.

Combination 92 is formed into a spacer assemblies 94 by wrapping outer spacer member 90 about inner spacer member 10 such that adhesive 54 holds legs 95 in place about the outer surface of member 10. The corrugations provide the areas of reduced thickness that function as the stress relief areas. The advantage of using the corrugated shaped is that the stress relief areas do not have to be specifically positioned with respect to member 10. The space between each corrugation is small enough such that an area of reduced thickness is always close to an edge or corner of bottom wall 12 when outer spacer member 90 is wrapped around member 10.

Spacer assemblies 94 may then be used to form an insulating glazing unit similar to the unit depicted in FIG. 1 by gunning an adhesive 96 (such as hot melt butyl) along the exposed sides of outer spacer member 90. Spacer assembly 94 having the adhesive is then positioned between two glazing sheets 24 and passed through a heated roller press to wet out the adhesive onto the glass. When barrier 93 is used, the desiccant disposed in foam 91 is only accessible from the interior of the glazing unit.

Figure 20:
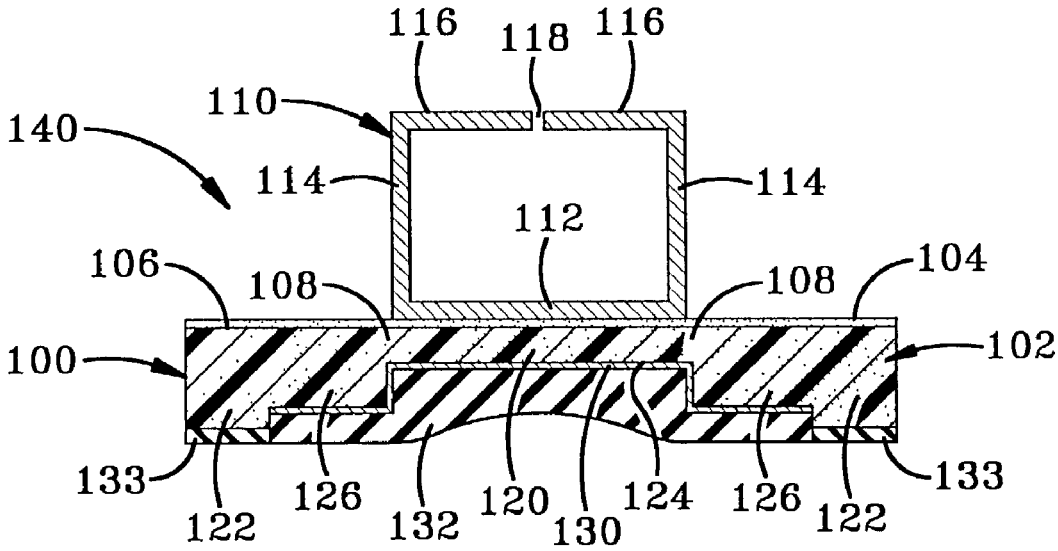
FIG. 20 is a sectional end view of a fifth embodiment of the outer spacer member initially positioned with respect to another inner spacer member.
Figure 21:
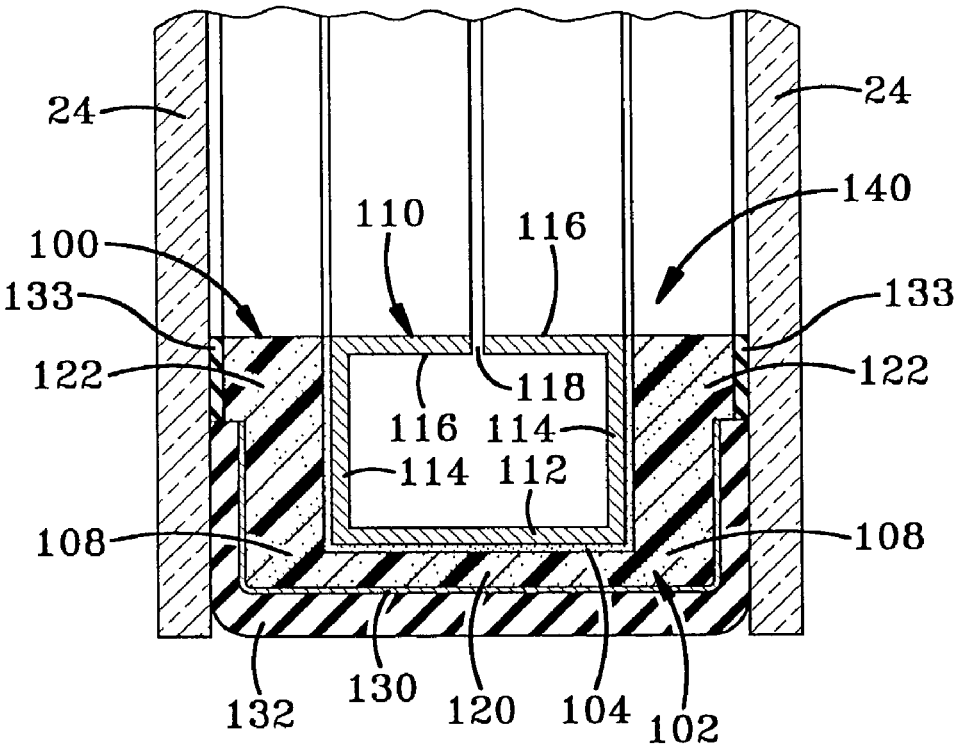
FIG. 21 is a sectional end view of the fifth embodiment of the spacer assembly of the invention positioned between first and second glazing sheets.

A fifth embodiment of an outer spacer member made in accordance with the concepts of the present invention is indicated generally by the numeral 100 in FIGS. 20 and 21. In accordance with the objectives of the present invention, outer spacer member 100 includes a layer of foam 102 carrying a desiccant. Other nonmetallic materials may also be used in place of foam 102. Pressure sensitive adhesive 104 is mounted on the inner surface 106 of foam 102. Foam 102 has a pair of stress-relief areas 108 that allow foam 102 to easily fold when it is wrapped about the outside of an inner spacer member 110. In this embodiment, each stress-relief area 108 is simply an area of reduced thickness where foam 102 is necked down from a thick area to a thin area. In other embodiments, foam 102 may be configured to easily bend.

Another version of an inner spacer member is depicted in FIGS. 20 and 21 and is indicated generally by the numeral 110. Inner spacer member 110 has a generally hollow rectangular cross section and is formed by roll forming a length of thin material into a box. Inner spacer member 110 preferably is fabricated from a metal. Inner spacer member 110 thus includes a bottom wall 112 and a pair of upstanding side walls 114. Inner spacer member 110 further includes a pair of opposed top walls 116 that may engage each other or be spaced apart by a gap 118 as shown in the drawings. Inner spacer member 110 may be supplied in lengths for each side of a glazing unit frame before the outer spacer member is connected to the inner spacer member. The joined members are then formed into a frame with appropriate corner elements. Inner member 110 also may be continuously roll formed and continuously connected to the outer spacer member to form the spacer assembly.

In the fifth embodiment of the present invention, each stress-relief area 108 is at an end of the base 120. As above, base 120 of foam 102 is equal to the width of bottom wall 112 of metal spacer member 110. Outer spacer member 100 also is formed with legs 122 having sufficient width to substantially cover the outer surface of inner spacer member 110 when member 100 is wrapped about member 110. As shown in FIGS. 20 and 21, the thickness of each leg 122 is greater than the thickness of base 120 thus forming a longitudinal concave depression 124 in the outwardly-facing surface of foam 102. The thickness of each leg 122 may be stepped to form an intermediate portion 126 between the end of each leg 122 and base 120.

Outer spacer member 100 further includes a moisture-vapor barrier 130 disposed on the outwardly-facing surface of foam 102. In the second embodiment of the invention, barrier 130 extends across the entire width of concave depression 124 but does not extend entirely across legs 122. A sealant 132 is disposed on the outside surface of barrier 130. Sealant 132 may be any one of a variety of adhesives known in the art (such as hot-melt butyl) that provide a moisture-vapor barrier when adhered to a glass surface. Outer spacer member 100 may also include a layer of an acrylic adhesive 133 in addition to sealant 132 to add structural strength to the connection between spacer member 100 and sheets 24.

Outer spacer member 100 is formed and stored in long lengths—such as coiled lengths on reels—so that it may be used to form a spacer assembly 140 at a later time. Spacer assembly 140 is formed by wrapping outer spacer member 100 around at least two of the outer surfaces of inner spacer member 110. When outer spacer member 100 is wrapped around inner spacer member 110, legs 122 are folded up adjacent side walls 114 and base 120 is disposed below bottom wall 112. Adhesive 132 is folded up around the sides of member 110 such that it directly contacts glazing sheets 24 when spacer assembly 140 is sandwiched between glazing sheets 24 to form the insulating glazing unit. In the fourth embodiment of the invention when adhesive 133 is not present, the ends of legs 122 also directly contact the inner surface of glazing sheets 24 above sealant 132.

Each of outer spacer members 72, 83, 90, and 100 may be applied with automated equipment as described above. Each outer spacer member may thus be continuously applied to continuously-formed inner spacer member stock that will be folded into a frame. The outer spacer members may also be applied to inner spacer members that will be assembled into a frame with corner elements.

Figure 22:
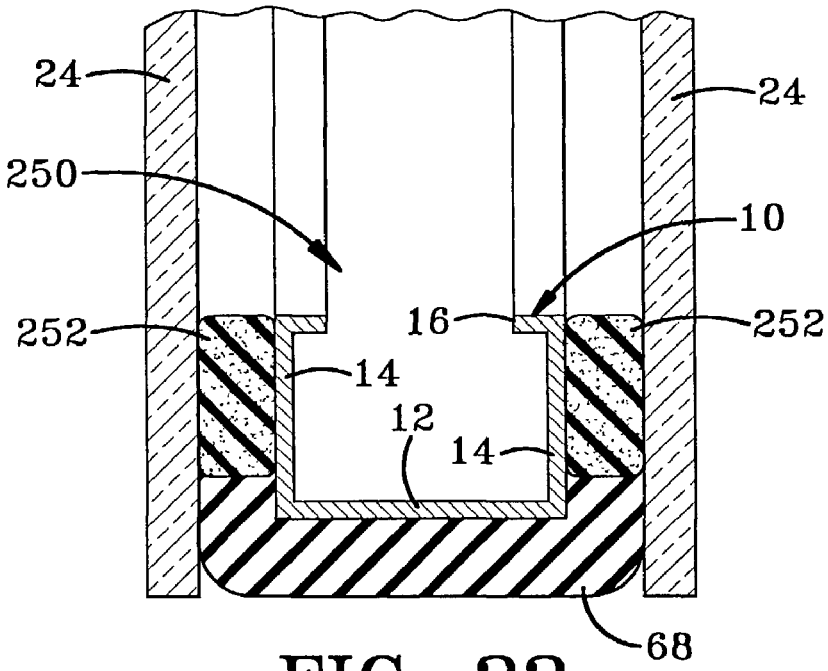
FIG. 22 is a sectional end view of a sixth embodiment of the spacer assembly of the present invention.

A sixth embodiment of the spacer assembly of the present invention is depicted in FIG. 22 and is indicated generally by the numeral 250. The desiccant is carried in a material such as an adhesive or a sealant 252 that can be gunned onto the edges of inner spacer member 10. Material 252 is disposed between sidewalls 14 and glazing sheets 24. Material 252 may be cured with heat and pressure or may be cured in a variety of other manners known to those skilled in the art such as curing material 252 with ultraviolet light or other similar curing methods that excite the molecules of material 252. For instance, material 252 may be extruded onto sidewalls 14 and positioned between glazing sheets 24. The unit may then be passed through rollers that provide pressure in the presence of UV light to cure material.

Material 252 may have varying degrees of permeability that allow the desiccant to function. The degree of permeability of adhesive 252 will partially depend on the type of sealant 68 being use behind member 10. For example, if sealant 68 is a low permeable sealant that hermetically seals the unit, adhesive 252 may have a higher permeability. When sealant 68 has a higher permeability than hot melt butyl, adhesive 252 may be less permeable. In the past, a highly permeably material was used to carry the desiccant. The high permeability was desired to ensure that any moisture in the cavity of the glazing unit would quickly contact the desiccant. In this embodiment, the desiccant is disposed in the tortuous path such that any moisture attempting to enter the cavity must pass through the desiccant. The cavity of the glazing unit is sealed by an appropriate sealant 68. The major advantage of this configuration is that the fabrication process does not include a laminating or wrapping step. Assembly 250 may be fabricated simply by extruding or gunning sealant 68 and adhesive 252 onto the outer surfaces of inner spacer member 10 and then positioning it between the sheets of glass.

Figure 23:
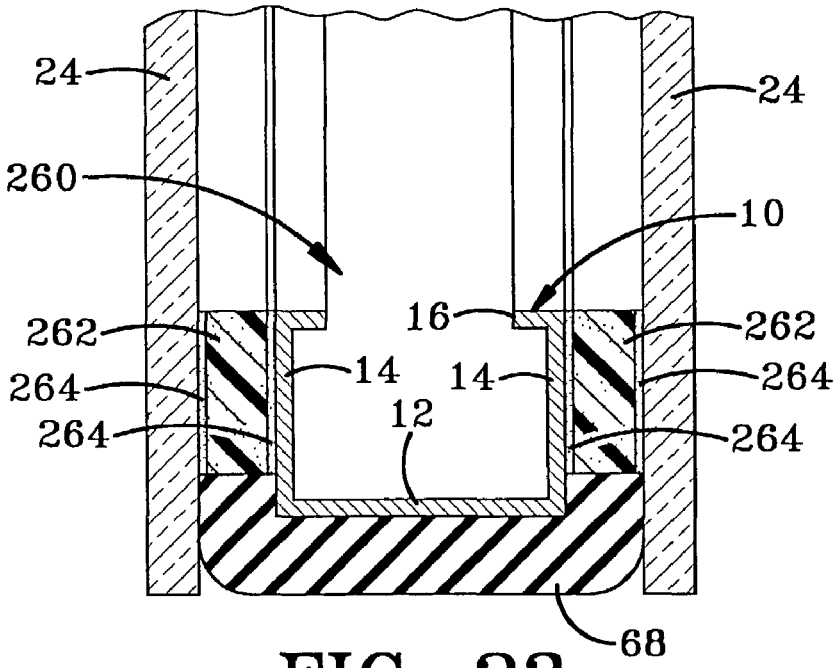
FIG. 23 is a sectional end view of a seventh embodiment of the spacer assembly of the present invention.

A seventh embodiment of the spacer assembly of the present invention is depicted in FIG. 23 and is indicated generally by the numeral 260. In this embodiment, the desiccant is carried by a pair of foam members 262 that are connected to sidewalls 14 by strips of adhesive 264 such as pressure sensitive adhesive. Members 262 may be sized to create an outwardly-facing channel that is substantially filled with a sealant 68.

Spacer assembly 260 may also be fabricated in an automated assembly process where long lengths of foam members 262 are applied to sidewalls 14 in a lamination process. The members are cut to the desired length and then applied or applied and then cut to length. The overall width of spacer assembly 260 is adjusted by varying the width of inner spacer member 10. Members 262 are fabricated at a fixed width and thickness so that the designer of spacer assembly 260 has a constant dimension to work from. The corners may be formed as described above with respect to FIGS. 7-9.

Figure 24:
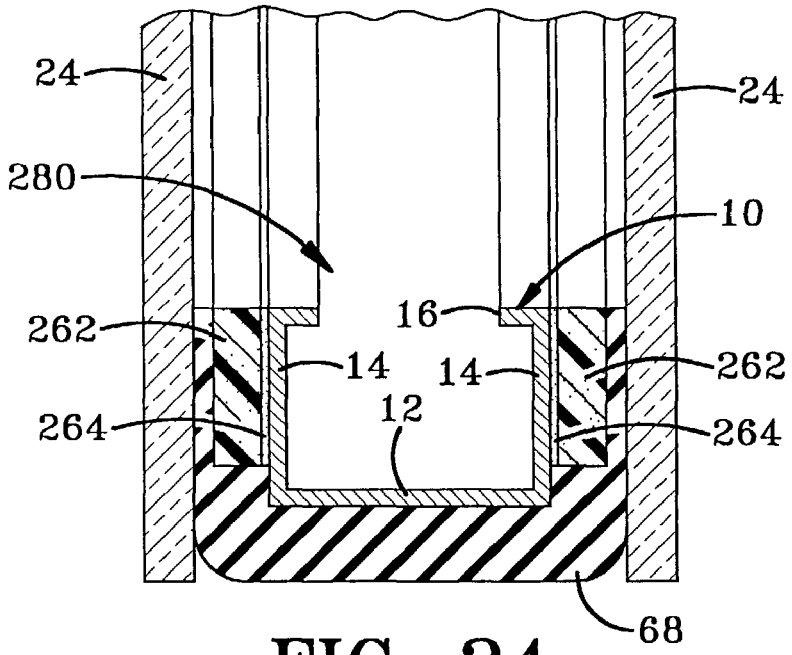
FIG. 24 is a sectional end view of an eighth embodiment of the spacer assembly of the present invention.

An eighth embodiment of the spacer assembly of the present invention is depicted in FIG. 24 and is indicated generally by the numeral 280. Spacer assembly 280 is similar to spacer assembly 260 except that foam members 262 are only attached to legs 14 with adhesive 264. Sealant 68 is disposed between members 262 and glazing sheets 24.

Figure 25:
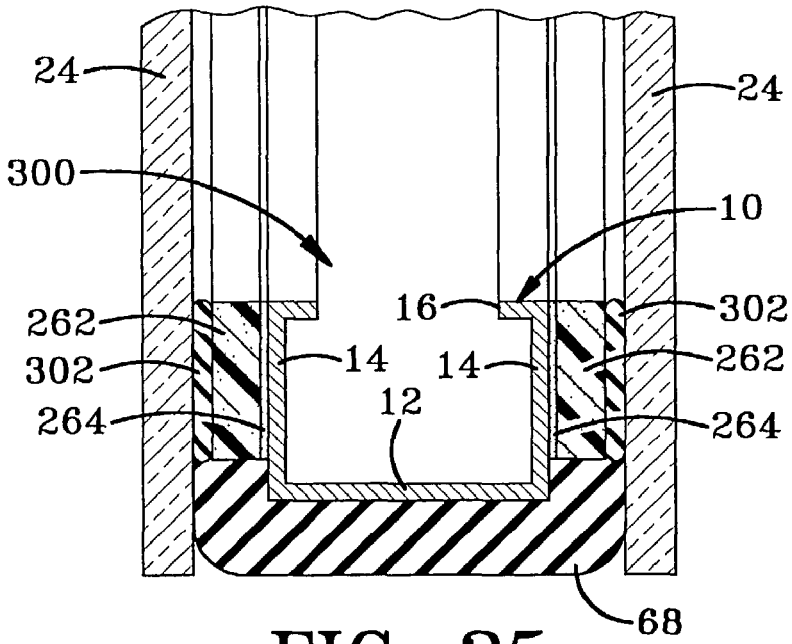
FIG. 25 is a sectional end view of a ninth embodiment of the spacer assembly of the present invention.

A ninth embodiment of the spacer assembly of the present invention is depicted in FIG. 25 and is indicated generally by the numeral 300. Spacer assembly 300 is similar to spacer assembly 280 except that a structural sealant 302 is disposed between members 262 and glazing sheets 24.

Figure 26:
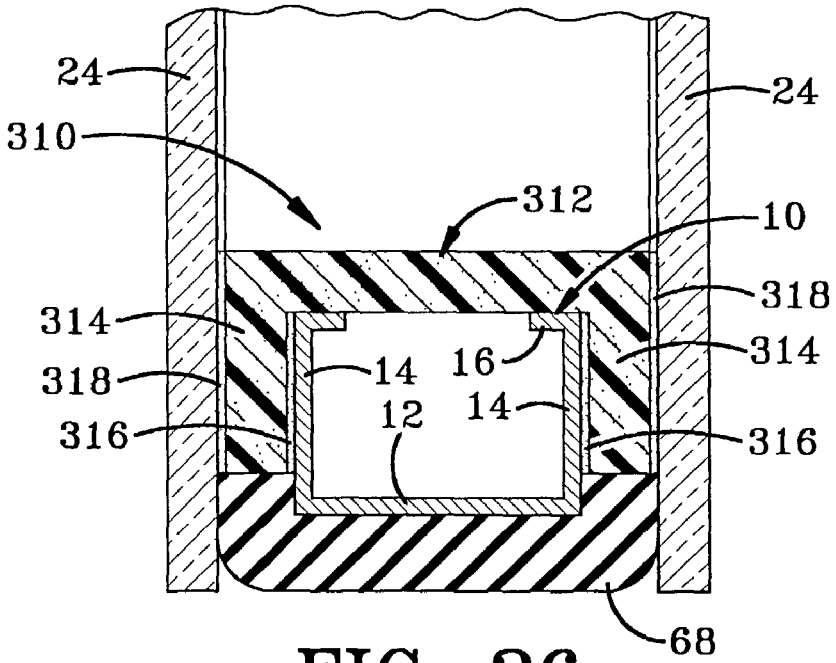
FIG. 26 is a sectional end view of a tenth embodiment of the spacer assembly of the present invention.

A tenth embodiment of the spacer assembly of the present invention is depicted in FIG. 26 and is indicated generally by the numeral 310. Spacer assembly 310 includes outer spacer member 312 that wraps around inner spacer member 10. In this embodiment, outer spacer member 312 extends across the inwardly-facing surface of inner spacer member 10 so that inner spacer member 10 is not visible when the window is installed. Outer spacer member 312 thus improves the aesthetic appearance of the window. Outer spacer member 312 may be provided in various colors as desired by the art and may be provided in warm colors.

Outer spacer member 312 includes a pair of legs 314 that extend down the outer sides of inner spacer member 10. Legs 314 may be connected to inner spacer member 10 with an adhesive 316. Legs 314 may also be attached to glazing sheets 24 with an adhesive 318. Outer spacer member 312 carries the desiccant for spacer assembly 310.

Spacer assembly 310 is used to space glazing sheets 24 with sealant 68 disposed behind spacer assembly 310 to provide the hermetic seal for the glazing unit. Outer spacer member 312 may be combined with any of the various other elements described above to form different spacer assemblies.

Figure 28:
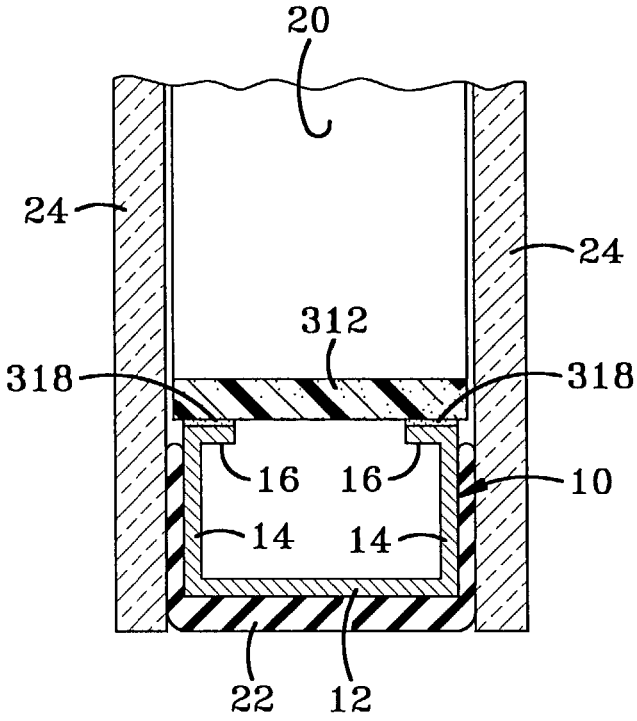
FIG. 28 is a sectional end view of an alternative embodiment of the spacer assembly of FIG. 27.

Outer spacer member 312 also may be used without legs 314 as shown in FIG. 28. In this configuration, inner spacer member 10 may be attached to glazing sheets 24 and sealed with any of the various configuration with an exemplary configuration depicted in FIG. 28. In the configuration depicted in FIG. 28, outer spacer member 312 may be applied to the inwardly-facing surface of inner member 10 before inner member 10 is folded into the frame used to form the glazing unit. When this configuration is used, portions of outer spacer member 312 become folded into the corners of the frame. To help the member fold, it may be partially slit at the corners to help it fold. In other embodiments, member 312 is cut to length so that it does not cover the corners before the inner spacer member is folded. The configuration of FIG. 28 may also be fabricated with a desiccant carried by or connected to a nonmetallic material 312 such as a tape, a flowable matrix (when the inwardly-facing surface is closed), a rigid material, or a foam. Material 312 may be colored for aesthetic appearance. Material 312 positions the desiccant material inwardly of the inner spacer member where the gas in the chamber of the glazing unit can easily contact the desiccant.

In some embodiments, a structural sealant may be used between inner spacer member 10 and glazing sheets 24. Outer spacer member 312 may be punched to hold muntins or muntin clips. The muntin clips may also be forced into outer spacer member 312 when the muntin clips include a sharp prong.

Figure 27:
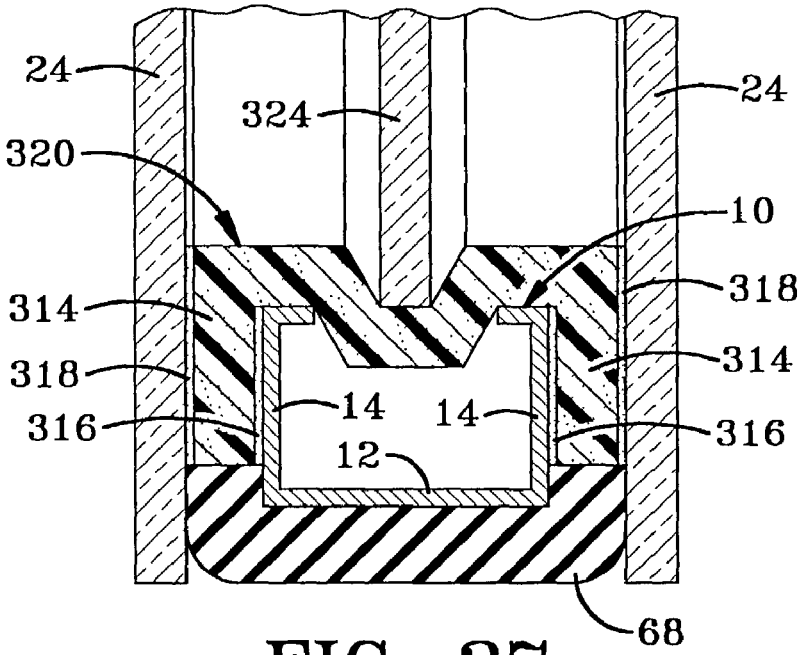
FIG. 27 is a sectional end view of a eleventh embodiment of the spacer assembly of the present invention.

In the embodiment of the invention shown in FIG. 27, outer spacer member 320 defines an inwardly-facing, glazing-sheet receiving channel 322 that holds the edge of an intermediate glazing sheet 324.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described.

The invention claimed is:

1. A method for forming a spacer assembly for an insulating glazing unit; the method comprising the steps of:

(a) providing an inner spacer member having an outer surface, a bottom wall and sidewalls;

(b) providing an outer spacer member having a corrugated surface; the outer spacer member being disposed in a flat configuration; the outer spacer member having a non-metallic body; the outer spacer member having a longitudinal direction; the outer spacer member being provided with stress relief areas located where the outer spacer member will be bent longitudinally; and (c) wrapping the outer spacer member from the flat configuration around the inner spacer member to a wrapped configuration wherein the outer spacer member is disposed adjacent to at least two of the walls of the inner spacer member; step (c) including the step of forming at least one longitudinal bend in the outer spacer member when the outer spacer member is wrapped around the walls of the inner spacer member.

2. The method of claim 1, wherein step (b) includes the step of providing an outer spacer member with a desiccant.

3. The method of claim 1, wherein step (b) includes the step of cutting the outer spacer member from a sheet of outer spacer material.

4. The method of claim 1, further comprising the step of:

(d) applying a sealant to the corrugated surface.

5. The method of claim 4, wherein step (d) occurs before step (c).

6. The method of claim 4, wherein step (d) occurs after step (c).

7. The method of claim 1, wherein step (c) includes the step of positioning the corrugated surface toward the inner spacer member.

8. The method of claim 1, wherein step (c) includes the step of positioning the corrugated surface away from the inner spacer member.

9. The method of claim 1, further comprising the step of varying the width of the spacer assembly by varying the width of the inner spacer member.

10. The method of claim 1, further comprising the step of varying the width of the spacer assembly by varying the thickness of the outer spacer member.

11. A method for forming a spacer assembly for an insulating glazing unit; the method comprising the steps of:

(a) providing an inner spacer member having an outer surface and at least two walls; the inner spacer member having a width and a height;

(b) providing a corrugated outer spacer member in a flat configuration; the outer spacer member having a longitudinal direction; the corrugated outer spacer member having a plurality of adjacent corrugations; the space between adjacent corrugations being smaller than the smaller of the width and height of the inner spacer member; and (c) wrapping the outer spacer member from a flat configuration around at least two walls of the inner spacer member wherein the outer spacer member is in a wrapped configuration; step (c) including the step of forming at least one longitudinal bend in the outer spacer member when the outer spacer member is wrapped around the walls of the inner spacer member.

12. The method of claim 11, further comprising the step of connecting the outer spacer member to the inner spacer member with an adhesive.

13. The method of claim 12, further comprising the step of applying sealant to the outer spacer member.

14. The method of claim 11, further comprising the step of connecting the corrugated surface of the outer spacer member to the outer surface of the inner spacer member.

15. The method of claim 11, further comprising the step of applying a sealant to the corrugated surface.

16. The method of claim 15, wherein step (c) occurs before the step of applying sealant to the corrugated surface.

17. The method of claim 11, wherein step (b) includes the step of providing the sheet of outer spacer material with a desiccant.

18. The method of claim 11, wherein step (c) includes the step of positioning the corrugated surface away from the inner spacer member.

* * * * *